US009657239B2

(12) United States Patent
Beech, Jr. et al.

(10) Patent No.: US 9,657,239 B2
(45) Date of Patent: May 23, 2017

(54) PYROLYSIS TAR UPGRADING USING RECYCLED PRODUCT

(71) Applicant: ExxonMobil Chemical Patents Inc., Baytown, TX (US)

(72) Inventors: James H. Beech, Jr., Kingwood, TX (US); Reyyan Koc-Karabocek, Houston, TX (US); William E. Lewis, Baton Rouge, LA (US); Teng Xu, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 131 days.

(21) Appl. No.: 14/683,511

(22) Filed: Apr. 10, 2015

(65) Prior Publication Data

US 2015/0368570 A1 Dec. 24, 2015

Related U.S. Application Data

(60) Provisional application No. 62/015,036, filed on Jun. 20, 2014.

(30) Foreign Application Priority Data

Aug. 18, 2014 (EP) ..... 14181263

(51) Int. Cl.

| | |
|---|---|
| ***C10G 69/06*** | (2006.01) |
| ***C10G 49/00*** | (2006.01) |
| ***C10G 49/22*** | (2006.01) |
| ***C10G 45/02*** | (2006.01) |
| ***C10G 45/44*** | (2006.01) |
| ***C10G 45/58*** | (2006.01) |
| ***C10G 47/00*** | (2006.01) |
| *C10G 69/00* | (2006.01) |
| *C10G 49/24* | (2006.01) |
| *C10L 1/04* | (2006.01) |

(52) U.S. Cl.

CPC ..... *C10G 69/06* (2013.01); *C10G 45/02* (2013.01); *C10G 45/44* (2013.01); *C10G 45/58* (2013.01); *C10G 47/00* (2013.01); *C10G 49/00* (2013.01); *C10G 49/22* (2013.01); *C10G 2300/4081* (2013.01)

(58) Field of Classification Search

CPC ..... C10G 49/00; C10G 49/22; C10G 49/24; C10G 69/00; C10G 69/06; C10G 2300/4031; C10G 2300/4081; C10L 1/04

See application file for complete search history.

(56) References Cited

U.S. PATENT DOCUMENTS

| | | | |
|---|---|---|---|
| 2,382,260 | A | 8/1945 | Schaad |
| 5,158,668 | A | 10/1992 | Chahar et al. |
| 6,632,351 | B1 | 10/2003 | Ngan et al. |
| 7,090,765 | B2 | 8/2006 | Spicer et al. |

(Continued)

FOREIGN PATENT DOCUMENTS

| | | |
|---|---|---|
| WO | 2013/033582 | 3/2013 |
| WO | 2013/033590 | 3/2013 |

*Primary Examiner* — Brian McCaig

(57) ABSTRACT

The invention relates to a process for upgrading pyrolysis tar in the presence of a utility fluid. The utility fluid contains 1-ring and/or 2-ring aromatics and has a final boiling point ≤430° C. The invention also relates to the upgraded pyrolysis tar, and to the use of the upgraded pyrolysis tar, e.g., for fuel oil blending.

26 Claims, 7 Drawing Sheets

(56) References Cited

U.S. PATENT DOCUMENTS

| | | | | |
|---|---|---|---|---|
| 7,097,758 | B2 | 8/2006 | Stell et al. | |
| 7,138,047 | B2 | 11/2006 | Stell et al. | |
| 7,220,887 | B2 | 5/2007 | Stell et al. | |
| 7,235,705 | B2 | 6/2007 | Stell | |
| 7,244,871 | B2 | 7/2007 | Stell et al. | |
| 7,247,765 | B2 | 7/2007 | Stell et al. | |
| 7,297,833 | B2 | 11/2007 | Beattie et al. | |
| 7,311,746 | B2 | 12/2007 | Stell et al. | |
| 7,312,371 | B2 | 12/2007 | Stell et al. | |
| 7,351,872 | B2 | 4/2008 | Stell et al. | |
| 7,488,459 | B2 | 2/2009 | Stell et al. | |
| 7,578,929 | B2 | 8/2009 | Stell et al. | |
| 7,820,035 | B2 | 10/2010 | McCoy et al. | |
| 8,083,931 | B2 | 12/2011 | McCoy et al. | |
| 9,090,835 | B2 | 7/2015 | Beech, Jr. et al. | |
| 2013/0233764 | A1* | 9/2013 | Brown | C10G 69/06<br>208/14 |

* cited by examiner

PYROLYSIS TAR UPGRADING USING RECYCLED PRODUCT

CROSS REFERENCE TO RELATED APPLICATIONS

This application claims priority to and the benefit of Ser. No. 62/015,036, filed Jun. 20, 2014, and EP 14181263.6 filed Aug. 18, 2014 the disclosures of which are incorporated by reference in their entireties.

FIELD OF THE INVENTION

The invention relates to a process for upgrading pyrolysis tar, such as steam cracker tar, and to the use of the upgraded pyrolysis tar, e.g., for fuel oil blending.

BACKGROUND OF THE INVENTION

Pyrolysis processes, such as steam cracking, can be utilized for converting saturated hydrocarbons to higher-value products such as light olefin, e.g., ethylene and propylene. Besides these useful products, hydrocarbon pyrolysis can also produce a significant amount of relatively low-value heavy products, such as pyrolysis tar. When the pyrolysis is steam cracking, the pyrolysis tar can be identified as steam-cracker tar ("SCT").

SCT generally contains relatively high molecular weight molecules, conventionally called Tar Heavies ("TH"). Catalytic hydroprocessing of undiluted SCT leads to significant catalyst deactivation. For example, significant reactor coking is observed when hydroprocessing SCT at a temperature in the range of from 250° C. to 400° C., at a pressure in the range of 5400 kPa to 20,500 kPa, using (i) a treat gas containing molecular hydrogen and (ii) at least one catalyst containing one or more of Co, Ni, or Mo. The coking has been attributed to the presence of TH in the SCT.

It is conventional to lessen the amount of coking by hydroprocessing the tar in the presence of a utility fluid, e.g., a solvent having significant aromatics content. The hydroprocessed tar product generally has a decreased viscosity, decreased atmospheric boiling point range, and an increased hydrogen content over that of the SCT, resulting in improved compatibility with fuel oil blend-stocks. Conventional processes for SCT hydroprocessing, disclosed, e.g., in U.S. Pat. Nos. 2,382,260 and 5,158,668; and in PCT Patent Application Publication No. WO2013/033590, involve recycling a portion of the hydroprocessed tar for use as the utility fluid.

It can be desirable to maintain the SCT at a temperature ≤400° C. before and during hydroprocessing, and in any pre-heat stages upstream of the hydroprocessing reactor. Conventional methods for doing so are disclosed in PCT Patent Application Publication No. WO2013/033582, which describes combining the treat gas and utility fluid, preheating the utility fluid-treat gas mixture, and then adding the SCT to the heated mixture upstream of the hydroprocessing reactor. When utilizing hydroprocessed tar as a utility fluid, it is conventional to combine the hydroprocessed tar with a supplemental utility fluid obtained from an external source, e.g., Steam Cracked Naphtha ("SCN"), to further lessen increases in reactor pressure drop as can occur from the formation of coke deposits in the hydroprocessing reactor and/or SCT pre-heating equipment.

Since the supplemental utility fluid is a valuable product of the steam cracking process, there is a need for SCT hydroprocessing processes having a decreased need for supplemental utility fluid, particularly for such processes as can be operated over a broad SCT compositional range and/or a range of hydroprocessing temperature and pressure.

SUMMARY OF THE INVENTION

The invention relates to hydroprocessing of a pyrolysis tar in the presence of a utility fluid, where a greater portion of the utility fluid is obtained from the hydroprocessor effluent than is the case in conventional pyrolysis tar hydroprocessing. It has been observed that pyrolysis tar hydroprocessing is improved, e.g., with a lesser rate of reactor pressure drop increase and an increased hydroprocessor run length, when the utility fluid has 1-ring or 2-ring aromatics content ≥25 wt. %, and a final boiling point ≤430° C. It has now been found that such a utility fluid can be primarily obtained from the hydroprocessor effluent, with less or no need for a supplemental utility fluid.

In certain aspects, the invention relates to a hydrocarbon conversion process, the process comprising providing a pyrolysis feedstock which includes ≥10.0 wt. % hydrocarbon based on the weight of the pyrolysis feedstock, and pyrolysing the pyrolysis feedstock to produce a pyrolysis effluent comprising tar and ≥1.0 wt. % of $C_2$ unsaturates, based on the weight of the pyrolysis effluent. At least a portion of the tar is separated from the pyrolysis effluent, wherein the separated tar contains ≥90 wt. % of the pyrolysis effluent's molecules having an atmospheric boiling point of ≥290° C. The separated tar is catalytically hydroprocessed in the presence of a utility fluid and a hydrogen-containing treat gas to produce a hydroprocessed product. The utility fluid comprises 1-ring and/or 2-ring aromatics, in an amount ≥25.0 wt. % based on the weight of the utility fluid, and has a final boiling point ≤430° C. The hydroprocessing conditions include a utility fluid:tar weight ratio in the range of 0.05 to 4.0. A product overhead mixture and a product bottoms mixture are separated from the hydroprocessed product. The product overhead mixture comprises at least a portion of any unreacted treat gas. The product bottoms mixture comprises hydroprocessed tar. At least a product vapor stream, a product liquid stream, and a side stream are separated from the product bottoms mixture, the side stream having a final boiling point ≤430° C. and comprising 1-ring and/or 2-ring aromatics, in an amount ≥25.0 wt. % based on the weight of the side stream. At least a portion of the side stream is recycled for use as the utility fluid, wherein the utility fluid comprises ≥10.0 wt. % of the side stream, based on the weight of the utility fluid.

In other aspects, the invention relates to a steam cracked tar conversion process, the process comprising hydroprocessing a steam cracker tar in the presence of a hydrogen-containing treat gas and a utility fluid, the utility fluid having a first component and optionally a second component. The first utility-fluid component has a final boiling point ≤350° C. and comprises 1-ring and/or 2-ring aromatics in an amount ≥50.0 wt. %, based on the weight of the first utility-fluid component. The second utility-fluid component has a final boiling point ≤430° C. and comprises 1-ring and/or 2-ring aromatics in an amount ≥25.0 wt. %, based on the weight of the second utility-fluid component. The treat gas comprises ≥70.0 mole % of molecular hydrogen per mole of the treat gas. The process includes combining the steam cracked tar and the utility fluid to produce a tar-fluid mixture, and exposing the tar-fluid mixture and treat gas under hydroprocessing conditions to a temperature in the range of from 300° C. to 500° C. to produce a hydroprocessed product. The hydroprocessing conditions include a molecular hydrogen consumption rate ≤267 standard $m^3$ of molecular hydrogen per $m^3$ of steam cracked tar. At least a product overhead mixture and a product bottoms mixture are separated from the hydroprocessed product. The product overhead mixture comprises aromatics, hydrogen sulfide, and un-reacted treat gas. The product bottoms mixture comprises hydroprocessed tar. At least a product vapor stream, a product liquid stream, and a side stream are separated from product bottoms mixture, the side stream having a final boiling point ≤430° C. and comprising ≥25.0 wt. % of aromatics having one or two rings, based on the weight of the side stream. A spent treat gas mixture and a fluid are separated from the product overhead mixture. The spent treat gas mixture comprises molecular hydrogen and hydrogen sulfide. The fluid has an atmospheric final boiling point ≤350° C. and comprises ≥50.0 wt. % of aromatics having one or two rings, based on the weight of the fluid. The process further comprises (i) recycling at least a portion of the fluid, wherein the first utility-fluid component comprises the recycled fluid, and (ii) optionally recycling at least a portion of the side stream, wherein the second utility fluid component comprises at least a portion of the recycled side stream.

In other aspects, the invention relates to a steam cracked tar conversion process, the process comprising hydroprocessing a steam cracker tar in the presence of a hydrogen-containing treat gas and a utility fluid, the utility fluid having first and second components. The first utility-fluid component has a final boiling point ≤350° C. and comprises ≥50.0 wt. % of aromatics having one or two rings, based on the weight of the first utility fluid component. The second utility-fluid component has a final boiling point ≤430° C. and comprises ≥25.0 wt. % of aromatics having one or two rings, based on the weight of the second utility-fluid component. The process further includes combining the steam cracked tar, the treat gas, and the utility fluid to produce a mixture, and exposing the mixture under hydroprocessing conditions to a temperature in the range of from 300° C. to 500° C. to produce a hydroprocessed product, wherein (i) the utility fluid is combined with the steam cracked tar at a [utility fluid]:[steam cracked tar] weight ratio in the range of about 0.05 to 4.0. At least a product overhead mixture and a product bottoms mixture are separated from the hydroprocessed product. The product overhead mixture comprises aromatics, hydrogen sulfide and un-reacted treat gas. The product bottoms mixture comprises hydroprocessed tar. At least a product vapor stream, a liquid product stream and a side stream are separated from the product bottoms, the side stream having a final boiling point ≤about 430° C. and comprising ≥25.0 wt. % of aromatics having one or two rings, based on the weight of the side stream. At least a portion of the side stream is recycled, the second utility-fluid component comprising the recycled side stream. At least a spent treat gas mixture and a fluid are separated from the product overhead. The spent treat gas mixture comprises molecular hydrogen and hydrogen sulfide. The fluid has a final boiling point ≤350° C. and comprising ≥50.0 wt. % of aromatics having one or two rings, based on the weight of the fluid. At least a portion of the separated fluid is recycled, wherein the first utility-fluid component comprises the recycled fluid.

In other aspects, the invention relates to a hydrocarbon conversion process, the process comprising hydroprocessing a tar obtained from a pyrolysis effluent. The pyrolysis effluent is produced by pyrolysing a pyrolysis feedstock, the feedstock comprising ≥10.0 wt. % hydrocarbon based on the weight of the pyrolysis feedstock. The pyrolysis effluent comprises tar and ≥1.0 wt. % of $C_2$ unsaturates, based on the weight of the pyrolysis effluent. Tar is separated from the pyrolysis effluent, wherein the separated tar contains ≥90 wt. % of the pyrolysis effluent's molecules having an atmospheric boiling point of ≥290° C. At least a portion of the separated tar is hydroprocessed in the presence of (i) a hydrogen-containing treat gas and (ii) a utility fluid under catalytic hydroprocessing conditions, at a utility fluid:tar weight ratio in the range of 0.05 to 4.0, to produce a hydroprocessed product. The utility fluid comprises 1-ring and/or 2-ring aromatics, in an amount ≥25.0 wt. % based on the weight of the utility fluid, the utility fluid having a final boiling point ≤400° C. At least a product overhead mixture and a product bottoms mixture are separated from the hydroprocessed product. The product overhead mixture comprises a portion of the un-reacted treat gas and optionally hydrogen sulfide. The product bottoms mixture comprises hydroprocessed tar. At least a product vapor stream and a product liquid stream are separated from the product bottoms. At least a spent treat gas mixture and a fluid stream are separated from the product overhead mixture, the fluid stream having final boiling point ≤400° C. and comprising 1-ring and/or 2-ring aromatics, in an amount ≥25.0 wt. % based on the weight of the second bottoms liquid stream. The process further includes recycling at least a portion of the fluid stream, wherein the utility fluid comprises ≥10.0 wt. % of the recycled fluid stream, based on the weight of the utility fluid.

DESCRIPTION OF THE INVENTION

Figure 1:
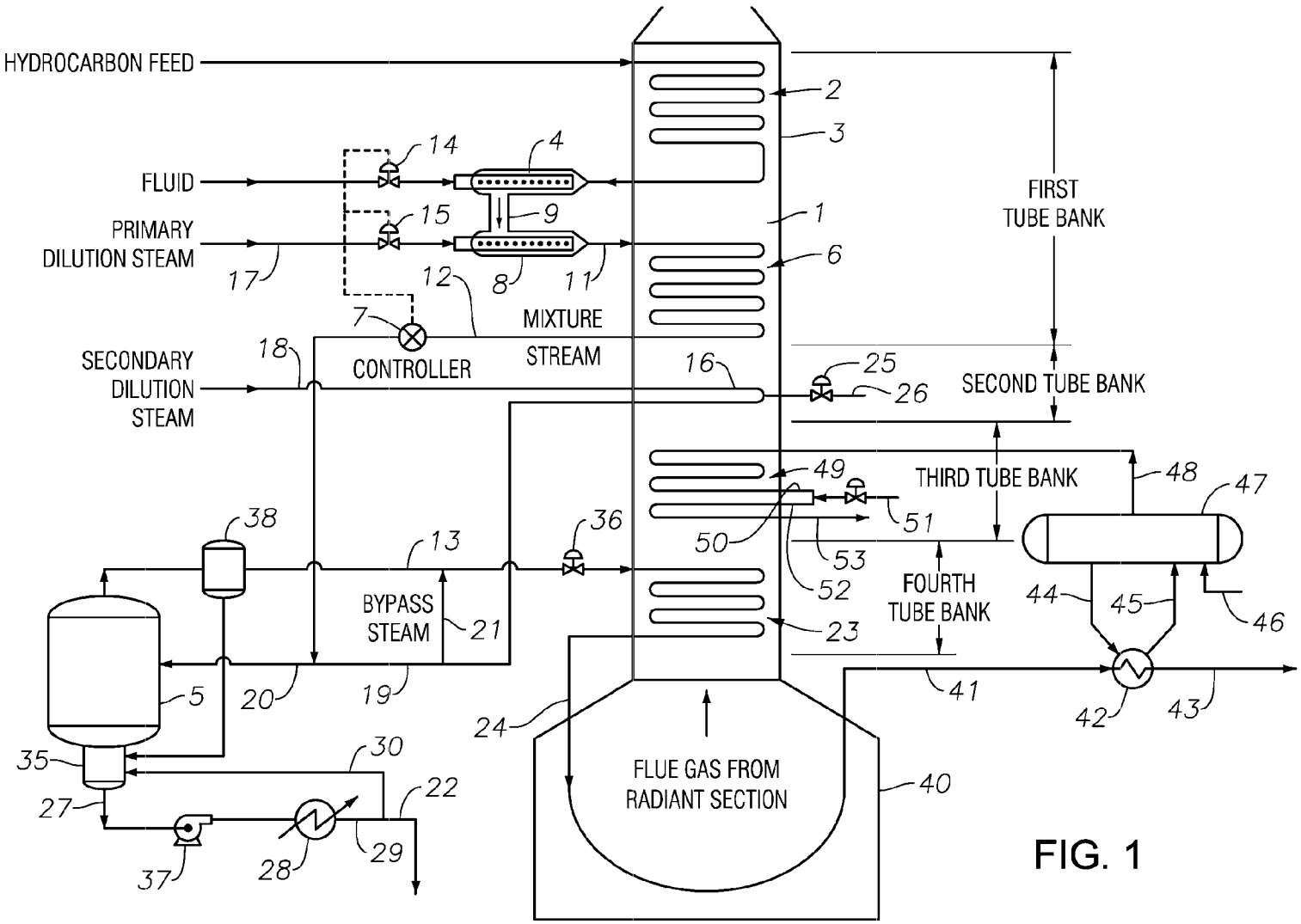
FIG. 1 is a processing schematic of a conventional hydrocarbon pyrolysis method, which produces light olefin and SCT.

Certain aspects of the invention relate to hydroprocessing a pyrolysis tar in the presence of a utility fluid. Pyrolysis tar can be produced by exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, when a feed comprising ≥10.0 wt. % hydrocarbon, based on the weight of the feed, is subjected to pyrolysis, the pyrolysis effluent generally contains pyrolysis tar and ≥1.0 wt. % of $C_2$ unsaturates, based on the weight of the pyrolysis effluent. The pyrolysis tar generally comprises ≥90 wt. % of the pyrolysis effluent's molecules having an atmospheric boiling point of ≥290° C. Besides hydrocarbon, the feed to pyrolysis optionally further comprise diluent, e.g., one or more of nitrogen, water, etc. For example, the feed may further comprise ≥1.0 wt. % diluent based on the weight of the feed, such as ≥25.0 wt. %. When the diluent includes an appreciable amount of steam, the pyrolysis is referred to as steam cracking. For the purpose of this description and appended claims, the following terms are defined:

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components and (ii) a number of carbon atoms ≥about 15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. "SCT" means pyrolysis tar obtained from steam cracking.

"Tar Heavies" (TH) means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane: SCT at 25.0° C. TH generally include asphaltenes and other high molecular weight molecules.

Aspects of the invention which include producing SCT by steam cracking will now be described in more detail. The invention is not limited to these aspects, and this description is not meant to foreclose other aspects within the broader scope of the invention, such as those which do not include steam cracking.

Obtaining Pyrolysis Tar by Steam Cracking

Conventional steam cracking utilizes a pyrolysis furnace which has two main sections: a convection section and a radiant section. The pyrolysis feedstock typically enters the convection section of the furnace where the pyrolysis feedstock's hydrocarbon is heated and vaporized by indirect contact with hot flue gas from the radiant section and by direct contact with the pyrolysis feedstock's steam. The vaporized pyrolysis feedstock is then introduced into the radiant section where ≥50% (weight basis) of the cracking takes place. A pyrolysis effluent is conducted away from the pyrolysis furnace, the pyrolysis effluent comprising products resulting from the pyrolysis of the pyrolysis feedstock and any unconverted components of the pyrolysis feedstock. At least one separation stage is generally located downstream of the pyrolysis furnace, the separation stage being utilized for separating from the pyrolysis effluent one or more of light olefin, SCN, SCGO, SCT, water, unreacted hydrocarbon components of the pyrolysis feedstock, etc. The separation stage can comprise, e.g., a primary fractionator. Generally, a cooling stage is located between the pyrolysis furnace and the separation stage. Conventional cooling means can be utilized by the cooling stage, e.g., one or more of direct quench and/or indirect heat exchange, but the invention is not limited thereto.

In certain aspects, the pyrolysis tar is SCT produced in one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules, and mixtures thereof. The liquid-phase products are generally conducted together to a separation stage, e.g., a primary fractionator, for separation of one or more of (a) overheads comprising steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 400° F. to 550° F. (200° C. to 290° C.), and (b) a bottoms stream comprising ≥90.0 wt. % SCT, based on the weight of the bottoms stream. The SCT can have, e.g., a boiling range ≥about 550° F. (290° C.) and can comprise molecules and mixtures thereof having a number of carbon atoms ≥about 15.

The pyrolysis feedstock typically comprises hydrocarbon and steam. In certain aspects, the pyrolysis feedstock comprises ≥10.0 wt. % hydrocarbon, based on the weight of the pyrolysis feedstock, e.g., ≥25.0 wt. %, ≥50.0 wt. %, such as ≥0.65 wt. %. Although the pyrolysis feedstock's hydrocarbon can comprise one or more of light hydrocarbons such as methane, ethane, propane, butane etc., it can be particularly advantageous to utilize the invention in connection with a pyrolysis feedstock comprising a significant amount of higher molecular weight hydrocarbons because the pyrolysis of these molecules generally results in more SCT than does the pyrolysis of lower molecular weight hydrocarbons. As an example, the pyrolysis feedstock can comprise ≥1.0 wt. % or ≥25.0 wt. % based on the weight of the pyrolysis feedstock of hydrocarbons that are in the liquid phase at ambient temperature and atmospheric pressure. More than one steam cracking furnace can be used, and these can be operated (i) in parallel, where a portion of the pyrolysis feedstock is transferred to each of a plurality of furnaces, (ii) in series, where at least a second furnace is located downstream of a first furnace, the second furnace being utilized for cracking unreacted pyrolysis feedstock components in the first furnace's pyrolysis effluent, and (iii) a combination of (i) and (ii).

In certain aspects, the pyrolysis feedstock's hydrocarbon comprises ≥5 wt. % of non-volatile components, based on the weight of the hydrocarbon portion, e.g., ≥30 wt. %, such as ≥40 wt %, or in the range of 5 wt. % to 50 wt. %. Non-volatile components are the fraction of the hydrocarbon feed with a nominal boiling point above 1100° F. (590° C.) as measured by ASTM D-6352-98, D-7580. These ASTM methods can be extrapolated, e.g., When a hydrocarbon has a final boiling point that is greater than that specified in the standard. The hydrocarbon's non-volatile components can include coke precursors, which are moderately heavy and/or reactive molecules, such as multi-ring aromatic compounds, which can condense from the vapor phase and then form coke under the operating conditions encountered in the present process of the invention. Examples of suitable hydrocarbons include, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The pyrolysis feedstock's hydrocarbon can have a nominal final boiling point of at least about 600° F. (315° C.), generally greater than about 950° F. (510° C.), typically greater than about 1100° F. (590° C.), for example greater than about 1400° F. (760° C.) Nominal final boiling point means the temperature at which 99.5 weight percent of a particular sample has reached its boiling point.

In certain aspects, the pyrolysis feedstock's hydrocarbon comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. When the hydrocarbon includes crude oil and/or one or more fractions thereof, the crude oil is optionally desalted prior to being included in the pyrolysis feedstock. An example of a crude oil fraction utilized in the pyrolysis feedstock is produced by separating atmospheric pipestill ("APS") bottoms from a crude oil and followed by vacuum pipestill ("VPS") treatment of the APS bottoms.

Suitable crude oils include, e.g., high-sulfur virgin crude oils, such as those rich in polycyclic aromatics. For example, the pyrolysis feedstock's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the pyrolysis feedstock's hydrocarbon comprises sulfur, e.g., ≥0.1 wt. % sulfur based on the weight of the pyrolysis feedstock's hydrocarbon, e.g., ≥1.0 wt. %, such as in the range of about 1.0 wt. % to about 5.0 wt. %. Optionally, at least a portion of the pyrolysis feedstock's sulfur-containing molecules, e.g., ≥10.0 wt. % of the pyrolysis feedstock's sulfur-containing molecules, contain at least one aromatic ring ("aromatic sulfur"). When (i) the pyrolysis feedstock's hydrocarbon is a crude oil or crude oil fraction comprising ≥0.1 wt. % of aromatic sulfur and (ii) the pyrolysis is steam cracking, then the SCT contains a significant amount of sulfur derived from the pyrolysis feedstock's aromatic sulfur. For example, the SCT sulfur content can be about 3 to 4 times higher in the SCT than in the pyrolysis feedstock's hydrocarbon component, on a weight basis.

It has been found that including sulfur and/or sulfur-containing molecules in the pyrolysis feedstock lessens the amount of olefinic unsaturation (and the total amount of olefin) present in the SCT. For example, when the pyrolysis feedstock's hydrocarbon comprises sulfur, e.g., ≥0.1 wt. % sulfur based on the weight of the pyrolysis feedstock's hydrocarbon, e.g., ≥1.0 wt. %, such as in the range of about 1.0 wt. % to about 5.0 wt. %, then the amount of olefin contained in the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because the presence of feed sulfur leads to an increase in amount of sulfur-containing hydrocarbon molecules in the pyrolysis effluent. Such sulfur-containing molecules can include, for example, one or more of mercaptans; thiophenols; thioethers, such as heterocyclic thioethers (e.g., dibenzosulfide; thiophenes, such as benzothiophene and dibenzothiophene; etc. The formation of these sulfur-containing hydrocarbon molecules is believed to lessen the amount of amount of relatively high molecular weight olefinic molecules (e.g., $C_{6+}$ olefin) produced during and after the pyrolysis, which results in fewer vinyl aromatic molecules available for inclusion in SCT, e.g., among the SCT's TH aggregates. In other words, when the pyrolysis feedstock includes sulfur, the pyrolysis favors the formation in the SCT of sulfur-containing hydrocarbon, such as $C_{6+}$ mercaptan, over $C_{6+}$ olefins such as vinyl aromatics.

In certain aspects, the pyrolysis feedstock comprises steam in an amount in the range of from 10.0 wt. % to 90.0 wt. %, based on the weight of the pyrolysis feedstock, with the remainder of the pyrolysis feedstock comprising (or consisting essentially of, or consisting of) the hydrocarbon. Such a pyrolysis feedstock can be produced by combining hydrocarbon with steam, e.g., at a ratio of 0.1 to 1.0 kg steam per kg hydrocarbon, or a ratio of 0.2 to 0.6 kg steam per kg hydrocarbon.

When the pyrolysis feedstock's diluent comprises steam, the pyrolysis can be carried out under conventional steam cracking conditions. Suitable steam cracking conditions include, e.g., exposing the pyrolysis feedstock to a temperature (measured at the radiant outlet) ≥400° C., e.g., in the range of 400° C. to 900° C., and a pressure ≥0.1 bar, for a cracking residence time period in the range of from about 0.01 second to 5.0 second. In certain aspects, the pyrolysis feedstock comprises hydrocarbon and diluent, wherein a. the pyrolysis feedstock's hydrocarbon comprises ≥50.0 wt. % based on the weight of the pyrolysis feedstock's hydrocarbon of one or more of one or more crude oils and/or one or more crude oil fractions, such as those obtained from an APS and/or VPS; waxy residues; atmospheric residues; naphthas contaminated with crude; various residue admixtures; and SCT; and
b. the pyrolysis feedstock's diluent comprises, e.g., ≥95.0 wt. % water based on the weight of the diluent, wherein the amount of diluent in the pyrolysis feedstock is in the range of from about 10.0 wt. % to 90.0 wt. %, based on the weight of the pyrolysis feedstock.

In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

A pyrolysis effluent is conducted away from the pyrolysis furnace, the pyrolysis effluent being derived from the pyrolysis feedstock by the pyrolysis. When utilizing the specified pyrolysis feedstock and pyrolysis conditions of any of the preceding aspects, the pyrolysis effluent generally comprises ≥1.0 wt. % of $C_2$ unsaturates and ≥0.1 wt. % of TH, the weight percents being based on the weight of the pyrolysis effluent. Optionally, the pyrolysis effluent comprises ≥5.0 wt. % of $C_2$ unsaturates and/or ≥0.5 wt. % of TH, such as ≥1.0 wt. % TH. Although the pyrolysis effluent generally contains a mixture of the desired light olefins, SCN, SCGO, SCT, and unreacted components of the pyrolysis feedstock (e.g., water in the case of steam cracking, but also in some cases unreacted hydrocarbon), the relative amount of each of these generally depends on, e.g., the pyrolysis feedstock's composition, pyrolysis furnace configuration, process conditions during the pyrolysis, etc. The pyrolysis effluent is generally conducted away for the pyrolysis section, e.g., for cooling and separation.

In certain aspects, the pyrolysis effluent's TH comprise ≥10.0 wt. % of TH aggregates having an average size in the range of 10.0 nm to 300.0 nm in at least one dimension and an average number of carbon atoms ≥50, the weight percent being based on the weight of Tar Heavies in the pyrolysis effluent. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Although it is not required, the invention is compatible with cooling the pyrolysis effluent downstream of the pyrolysis furnace, e.g., the pyrolysis effluent can be cooled using a system comprising transfer line heat exchangers. For example, the transfer line heat exchangers can cool the process stream to a temperature in the range of about 700° C. to 350° C., in order to efficiently generate super-high pressure steam which can be utilized by the process or conducted away. If desired, the pyrolysis effluent can be subjected to direct quench at a point typically between the furnace outlet and the separation stage. The quench can be accomplished by contacting the pyrolysis effluent with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench fluids include liquid quench oil, such as those obtained by a downstream quench oil knock-out drum, pyrolysis fuel oil and water, which can be obtained from conventional sources, e.g., condensed dilution steam.

A separation stage can be utilized downstream of the pyrolysis furnace and downstream of the transfer line exchanger and/or quench point for separating from the pyrolysis effluent one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. The separation stage can be utilized for separating an SCT-containing tar stream (the "tar stream") from the pyrolysis effluent. The tar stream typically contains ≥90.0 wt. % of SCT based on the weight of the tar stream, e.g., ≥95.0 wt. %, such as ≥99.0 wt. %, with the balance of the tar stream being particulates, for example. The tar stream's SCT generally comprises ≥10.0% (on a weight basis) of the pyrolysis effluent's TH. The tar stream can be obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the tar stream can be a mixture of primary fractionator bottoms and tar knock-out drum bottoms.

In certain aspects, the SCT comprises ≥50.0 wt. % of the pyrolysis effluent's TH based on the weight of the pyrolysis effluent's TH. For example, the SCT can comprise ≥90.0 wt. % of the pyrolysis effluent's TH based on the weight of the pyrolysis effluent's TH. The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.15 g/cm$^3$, e.g., in the range of 1.07 g/cm$^3$ to 1.15 g/cm$^3$; and (iv) a 50° C. viscosity in the range of 200 cSt to $1.0\times10^7$ cSt. The amount of olefin the SCT is generally ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is generally ≤5.0 wt. %, e.g., ≤3 wt. %, such as ≤2.0 wt. %, based on the weight of the SCT.

Vapor-Liquid Separator

Optionally, the pyrolysis furnace has at least one vapor/liquid separation device (sometimes referred to as flash pot or flash drum) integrated therewith. The vapor-liquid separator is utilized for upgrading the pyrolysis feedstock before exposing it to pyrolysis conditions in the furnace's radiant section. It can be desirable to integrate a vapor-liquid separator with the pyrolysis furnace when the pyrolysis feedstock's hydrocarbon comprises ≥1.0 wt. % of non-volatiles, e.g., ≥5.0 wt. %, such as 5.0 wt. % to 50.0 wt. % of non-volatiles having a nominal boiling point ≥1400° F. (760° C.). The boiling point distribution and nominal boiling points of the pyrolysis feedstock's hydrocarbon are measured by Gas Chromatograph Distillation (GCD) according to the methods described in ASTM D-6352-98 or D-2887, extended by extrapolation for materials having a boiling point at atmospheric pressure ("atmospheric boiling point) ≥700° C. (1292° F.). It is particularly desirable to integrate a vapor/liquid separator with the pyrolysis furnace when the non-volatiles comprise asphaltenes, such as pyrolysis feedstock's hydrocarbon comprises ≥about 0.1 wt. % asphaltenes based on the weight of the pyrolysis feedstock's hydrocarbon component, e.g., ≥about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the device is substantially the same as the composition of the liquid phase entering the device, i.e., the separation in the vapor/liquid separation device includes (or even consists essentially of) a physical separation of the two phases entering the device.

In aspects which include integrating a vapor/liquid separation device with the pyrolysis furnace, at least a portion of the pyrolysis feedstock's hydrocarbon is provided to the inlet of a convection section of a pyrolysis unit, wherein hydrocarbon is heated so that at least a portion of the hydrocarbon is in the vapor phase. When a diluent (e.g., steam) is utilized, the pyrolysis feedstock's diluent is optionally (but preferably) added in this section and mixed with the hydrocarbon to produce the pyrolysis feedstock. The pyrolysis feedstock, at least a portion of which is in the vapor phase, is then flashed in at least one vapor/liquid separation device in order to separate and conduct away from the pyrolysis feedstock at least a portion of the pyrolysis feedstock's non-volatiles, e.g., high molecular-weight non-volatile molecules, such as asphaltenes. A bottoms fraction can be conducted away from the vapor-liquid separation device, the bottoms fraction comprising, e.g., ≥10.0% (on a wt.

basis) of the pyrolysis feedstock's non-volatiles, such as ≥10.0% (on a wt. basis) of the pyrolysis feedstock's asphaltenes.

One of the advantages obtained when utilizing an integrated vapor-liquid separator is the lessening of the amount of $C_{6+}$ olefin in the SCT, particularly for when the pyrolysis feedstock's hydrocarbon has a relatively high asphaltene content and a relatively low sulfur content. Such hydrocarbons include, for example, those having (i) ≥about 0.1 wt. % asphaltenes based on the weight of the pyrolysis feedstock's hydrocarbon component, e.g., ≥about 5.0 wt. %; (ii) a final boiling point ≥600° F. (315° C.), generally ≥950° F. (510° C.), or ≥1100° F. (590° C.), or ≥1400° F. (760° C.); and optionally (iii) ≤5 wt. % sulfur, e.g., ≤1.0 wt. % sulfur, such as ≤0.1 wt. % sulfur. It is observed that utilizing an integrated vapor-liquid separator when pyrolysing these hydrocarbons in the presence of steam, the amount of olefin the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because precursors in the pyrolysis feedstock's hydrocarbon that would otherwise form $C_6$+ olefin in the SCT are separated from the pyrolysis feedstock in the vapor-liquid separator and conducted away from the process before the pyrolysis. Evidence of this feature is found by comparing the density of SCT obtained by crude oil pyrolysis. For conventional steam cracking of a crude oil fraction, such as vacuum gas oil, the SCT is observed to have an API gravity (measured at 15.6° C.) the range of about −1° API to about 6° API. API gravity is an inverse measure of the relative density, where a lesser (or more negative) API gravity value is an indication of greater SCT density. When the same hydrocarbon is pyrolysed utilizing an integrated vapor-liquid separator operating under the specified conditions, the SCT density is increased, e.g., to an API gravity ≤−7.5° API, such as ≤−8.0° API, or ≤−8.5° API.

Another advantage obtained when utilizing a vapor/liquid separator integrated with the pyrolysis furnace is that it increases the range of hydrocarbon types available to be used directly, without pretreatment, as hydrocarbon components in the pyrolysis feedstock. For example, the pyrolysis feedstock's hydrocarbon component can comprise ≥50.0 wt. %, e.g., ≥75.0 wt. %, such as ≥90.0 wt. % (based on the weight of the pyrolysis feedstock's hydrocarbon) of one or more crude oils, even high naphthenic acid-containing crude oils and fractions thereof. Feeds having a high naphthenic acid content are among those that produce a high quantity of SCT and are especially suitable when at least one vapor/liquid separation device is integrated with the pyrolysis furnace. If desired, the pyrolysis feedstock's composition can vary over time, e.g., by utilizing a pyrolysis feedstock having a first hydrocarbon during a first time period and then, during a second time period, substituting for at least a portion of the first hydrocarbon a second hydrocarbon. The first and second hydrocarbons can be substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This can be utilized for the sequential pyrolysis of incompatible first and second hydrocarbon components (i.e., where the first and second hydrocarbon components are mixtures that are not sufficiently compatible to be blended under ambient conditions). For example, the pyrolysis feedstock can comprise a first hydrocarbon during a first time period and a second hydrocarbon (one that is substantially incompatible with the first hydrocarbon) during a second time period. The first hydrocarbon can comprise, e.g., a virgin crude oil. The second hydrocarbon can comprise SCT.

In certain aspects a pyrolysis furnace is integrated with a vapor-liquid separator device as illustrated schematically in FIG. 1. A hydrocarbon feed is introduced into furnace 1, the hydrocarbon being heated by indirect contact with hot flue gasses in the upper region (farthest from the radiant section) of the convection section. The heating is accomplished by passing at least a portion of the hydrocarbon feed through a bank of heat exchange tubes 2 located within the convection section 3 of the furnace 1. The heated hydrocarbon feed typically has a temperature in the range of about 300° F. to about 500° F. (150° C. to 260° C.), such as about 325° F. to about 450° F. (160° C. to 230° C.), for example about 340° F. to about 425° F. (170° C. to 220° C.). Diluent (primary dilution steam) 17 is combined with the heated hydrocarbon feed in sparger 8 and of double sparger 9. Additional fluid, such as one or more of additional hydrocarbon, steam, and water, such as boiler feed water, can be introduced into the heated hydrocarbon via sparger 4. Generally, the primary dilution steam stream 17 is injected into the pyrolysis hydrocarbon feed before the combined hydrocarbon+steam mixture (the pyrolysis feedstock) enters the convection section at 11, for additional heating by flue gas. The primary dilution steam generally has a temperature greater than that of the pyrolysis feedstock's hydrocarbon, in order to at least partially vaporize the pyrolysis feedstock's hydrocarbon. The pyrolysis feedstock is heated again in the convection section of the pyrolysis furnace 3 before the vapor-liquid separation, e.g., by passing the pyrolysis feedstock through a bank of heat exchange tubes 6. The pyrolysis feedstock leaves the convection section as a re-heated pyrolysis feedstock 12. An optional secondary dilution steam stream can be introduced via line 18. If desired, the re-heated pyrolysis feedstock can be further heated by combining it with the secondary dilution steam 18 upstream of vapor-liquid separation. Optionally, the secondary dilution steam is split into (i) a flash steam stream 19 for mixing with the re-heated pyrolysis feedstock 12 before vapor-liquid separation and (ii) a bypass steam stream 21. The bypass steam bypasses the vapor-liquid separation and is instead mixed with a vapor phase that is separated from the re-heated pyrolysis feedstock in the vapor-liquid separator. The mixing is carried out before the vapor phase is cracked in the radiant section of the furnace. Alternatively, the secondary dilution steam 18 is directed to bypass steam stream 21 with no flash steam stream 19. In certain aspects, the ratio of the flash steam stream 19 to bypass steam stream 21 is 1:20 to 20:1, e.g., 1:2 to 2:1. The flash steam stream 19 is then mixed with the re-heated pyrolysis feedstock 12 to form a flash stream 20 before the flash in vapor-liquid separator 5. Optionally, the secondary dilution steam stream is superheated in a superheater section 16 in the furnace convection before splitting and mixing with the heavy hydrocarbon mixture. The addition of the flash steam stream 19 to the pyrolysis feedstock 12 aids the vaporization of most volatile components of the pyrolysis feedstock before the flash stream 20 enters the vapor-liquid separation vessel 5. The pyrolysis feedstock 12 or the flash stream 20 is then flashed, for separation of two phases: a vapor phase comprising predominantly volatile hydrocarbons and steam, and a liquid phase comprising predominantly non-volatile hydrocarbons. The vapor phase is preferably removed from vessel 5 as an overhead vapor stream 13. The vapor phase can be transferred to a convection section tube bank 23 of the furnace, e.g., at a location proximate to the radiant section of the furnace, for optional heating and through crossover pipes 24 to the radiant section 40 of the pyrolysis furnace for cracking. The liquid phase of the flashed mixture stream is removed from vessel 5 as a bottoms stream 27.

Typically, the temperature of the pyrolysis feedstock 12 can be set and controlled in the range of about 600° F. to about 1000° F. (315° C. to 540° C.), in response, e.g., to changes of the concentration of volatiles in the pyrolysis feedstock. The temperature can be selected to maintain a liquid phase in line 12 and downstream thereof to reduce the likelihood of coke formation on exchanger tube walls and in the vapor-liquid separator. The pyrolysis feedstock's temperature can be controlled by a control system 7, which generally includes a temperature sensor and a control device, which can be automated by way of a computer. The control system 7 communicates with the fluid valve 14 and the primary dilution steam valve 15 in order to regulate the amount of fluid and primary dilution xteam entering dual sparger 9. An intermediate desuperheater 25 can be utilized, e.g., to further avoid sharp variation of the flash temperature. After partial preheating, the secondary dilution steam exits the convection section and a fine mist of desuperheater water 26 is added, which rapidly vaporizes and reduces the steam temperature. This allows the superheater 16 outlet temperature to be controlled at a constant value, independent of furnace load changes, coking extent changes, excess oxygen level changes, and other variables. When used, desuperheater 25 generally maintains the temperature of the secondary dilution steam in the range of about 800° F. to about 1100° F. (425° C. to 590° C.). In addition to maintaining a substantially constant temperature of the mixture stream 12 entering the flash/separator vessel, it is generally also desirable to maintain a constant hydrocarbon partial pressure of the flash stream 20 in order to maintain a substantially constant ratio of vapor to liquid in the flash/separator vessel. By way of examples, a substantially constant hydrocarbon partial pressure can be maintained through the use of control valve 36 on the vapor phase line 13 and by controlling the ratio of steam to hydrocarbon pyrolysis feedstock in stream 20. Typically, the hydrocarbon partial pressure of the flash stream in the present invention is set and controlled in a range of about 4 psia to about 25 psia (25 kPa to 175 kPa), such as in a range of about 5 psia to about 15 psia (35 kPa to 100 kPa), for example in a range of about 6 psia to about 11 psia (40 kPa to 75 kPa).

Conventional vapor-liquid separation conditions can be utilized in vapor-liquid separator 5, such as those disclosed in U.S. Pat. No. 7,820,035. When the pyrolysis feedstock's hydrocarbon component comprises one or more crude oil or fractions thereof, the vapor/liquid separation device can operate at a temperature in the range of from about 600° F. to about 950° F. (about 350° C. to about 510° C.) and a pressure in the range of about 275 kPa to about 1400 kPa, e.g., a temperature in the range of from about 430° C. to about 480° C. and a pressure in the range of about 700 kPa to 760 kPa. A vapor phase conducted away from the vapor/liquid separation device can be subjected to further heating in the convection section, as shown in the figure. The re-heated vapor phase is then introduced via crossover piping into the radiant section where the overheads are exposed to a temperature ≥760° C. at a pressure ≥0.5 bar (gauge) e.g., a temperature in the range of about 790° C. to about 850° C. and a pressure in the range of about 0.6 bar (gauge) to about 2.0 bar (gauge), to carry out the pyrolysis (e.g., cracking and/or reforming).

Accordingly, vapor portion of the pyrolysis feedstock is conducted away from vapor-liquid separator 5 via line 25 and valve 56 for cracking in radiant section 40 of the pyrolysis furnace. A liquid portion of the pyrolysis feedstock is conducted away from vapor-liquid separator 5 vial line 27. Stream 27 can be conveyed from the bottom of the flash/separator vessel 5 to the cooler 28 via pump 37. The cooled stream 29 can then be split into a recycle stream 30 and an export stream 22. Recycle liquid in line 30 can be returned to drum 5 proximate to bottom section 35. The vapor phase may contain, for example, about 55% to about 70% hydrocarbon (by weight) and about 30% to about 15% steam (by weight). The final boiling point of the vapor phase is generally ≤1400° F. (760° C.), such as ≤1100° F. (590° C., for example below about 1050° F. (565° C.), or ≤about 1000° F. (540° C.). An optional centrifugal separator 38 can be used for removing from the vapor phase any entrained and/or condensed liquid. The vapor then returned to the furnace via a manifold that distributes the flow to the lower convection section 23 for heating, e.g., to a temperature in the range of about 800° F. to about 1300° F. (425° C. to 705° C.). The vapor phase is then introduced to the radiant section of the pyrolysis furnace to be cracked, optionally after mixing with bypass steam stream 21.

The radiant section's effluent can be rapidly cooled in a transfer-line exchanger 42 via line 41. Indirect cooling can be used, e.g., using water from a steam drum 47, via line 44, in a thermosyphon arrangement. Water can be added via line 46. The saturated steam 48 conducted away from the drum can be superheated in the high pressure steam superheater bank 49. The desuperheater can include a control valve/water atomizer nozzle 51, line 50 for transferring steam to the desuperheater, and line 52 for transferring steam away from the desuperheater. After partial heating, the high pressure steam exits the convection section via line 50 and water from 51 is added (e.g., as a fine mist) which rapidly vaporizes and reduces the temperature. The high pressure steam can be returned to the convection section via line 52 for further heating. The amount of water added to the superheater can control the temperature of the steam withdrawn via line 53.

After cooling in transfer-line exchanger 42, the pyrolysis effluent is conducted away via line 43, e.g., for separating from the pyrolysis effluent one or more of molecular hydrogen, water, unconverted feed, SCT, gas oils, pyrolysis gasoline, ethylene, propylene, and $C_4$ olefin.

In aspects where a vapor-liquid separator is integrated with the pyrolysis furnace, the SCT generally comprises ≥50.0 wt. % of the pyrolysis effluent's TH based on the weight of the pyrolysis effluent's TH, such as ≥90.0 wt. %. For example, the SCT can have (i) a TH content in the range of from 5.0 wt. % to 40.0 wt. %, based on the weight of the SCT; (ii) an API gravity (measured at a temperature of 15.8° C.) of ≤−7.5° API, such as ≤−8.0° API, or ≤−8.5° API; and (iii) a 50° C. viscosity in the range of 200 cSt to $1.0\times10^7$ cSt. The SCT can have, e.g., a sulfur content that is >0.5 wt. %, e.g., in the range of 0.5 wt. % to 7.0 wt. %. In aspects where pyrolysis feedstock does not contain an appreciable amount of sulfur, the SCT can comprise ≤0.5 wt. % sulfur, based on the weight of the SCT, e.g., ≤0.1 wt. %, such as ≤0.05 wt. %. The amount of olefin the SCT is generally ≤10.0 wt. %, e.g., ≤5.0 wt. %, such as ≤2.0 wt. %, based on the weight of the SCT. More particularly, the amount of (i) vinyl aromatics in the SCT is generally ≤5.0 wt. %, e.g., ≤3 wt. %, such as ≤2.0 wt. % and/or (ii) aggregates in the SCT which incorporate vinyl aromatics is generally ≤5.0 wt. %, e.g., ≤3 wt. %, such as ≤2.0 wt. %, the weight percents being based on the weight of the SCT.

SCT Hydroprocessing

Aspects of the invention relating to SCT hydroprocessing will now be described in more detail. The invention is not limited to SCT hydroprocessing, and this description is not meant to foreclose other aspects within the broader scope of the invention, such as those in which include hydroprocessing other kinds of pyrolysis tar.

Figure 2:
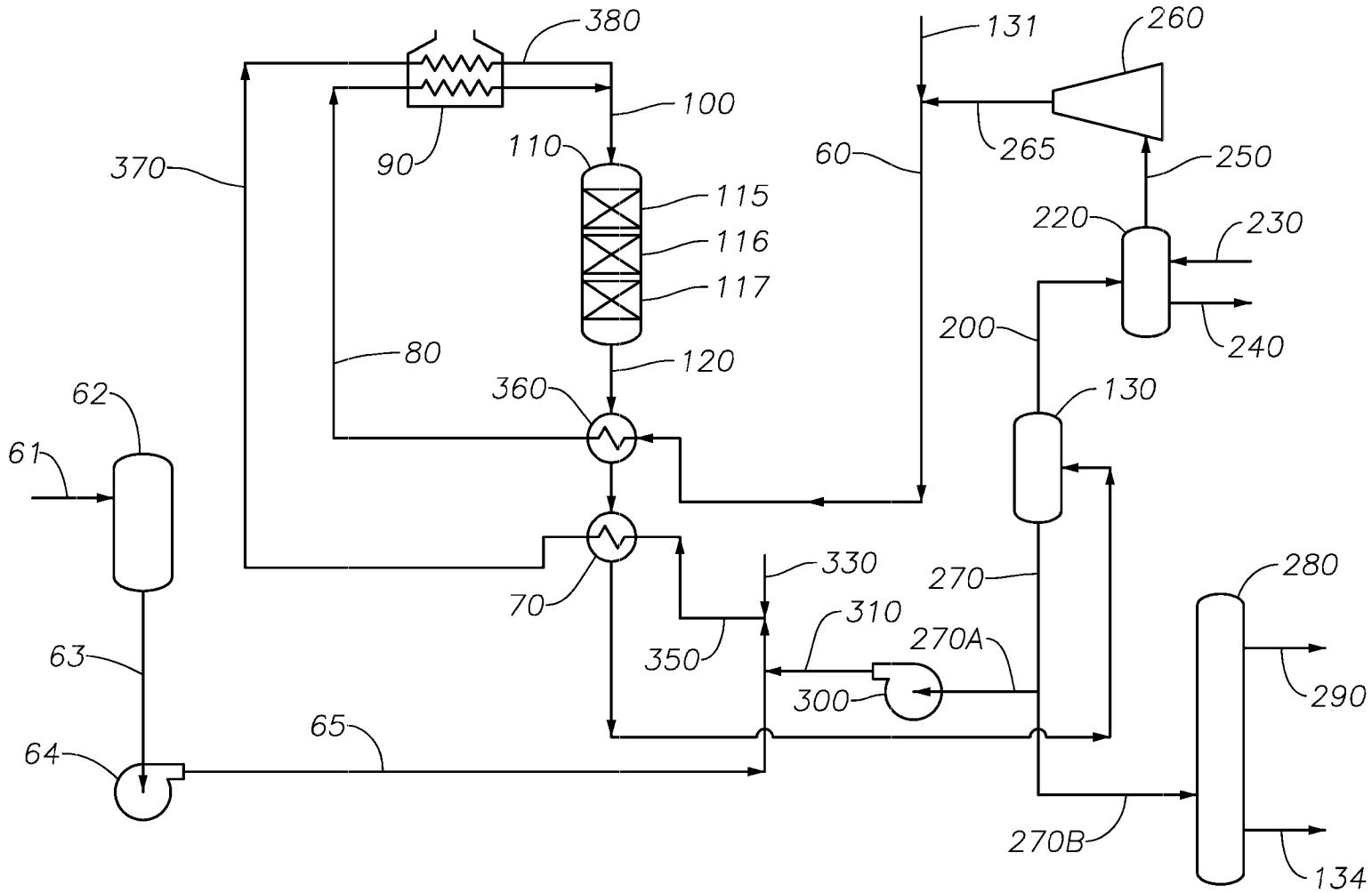
FIG. 2 is a processing schematic of a conventional SCT hydroprocessing process. The hydroprocessing is carried out in the presence of a utility fluid. The utility fluid comprises a recycled bottoms stream obtained from condensed hydroprocessed product.

FIG. 2 schematically illustrates certain conventional tar conversion processes operated in accordance with the disclosures of PCT Patent Application Publication Nos. WO2013/033690 and WO2013/033582, the specifications of which are incorporated by reference herein in their entirety. In accordance with one conventional process, a tar stream containing SCT is conducted via conduit 61 to separation stage 62 for separation of SCT and one or more light gases and/or particulates from the tar stream. The SCT is conducted via conduit 63 to pump 64 to increase the SCT's pressure, the higher-pressure SCT being conducted away via conduit 65. A utility fluid conducted via line 310 is combined with the SCT of line 65, with the tar-fluid mixture being conducted to a tar-fluid mixture pre-heater stage 70 via conduit 350. The utility fluid is utilized during SCT hydroprocessing e.g., for effectively increasing run-length during hydroprocessing and improving SCT properties. In certain aspects, the utility fluid comprises a portion of the liquid bottoms of separation stage 130, as shown in the figure. In other aspects, the utility fluid comprises at least a portion of liquid bottoms (not shown) of separator 280, or a mixture of liquid bottoms obtained from stages 130 and 280.

The conventional process typically utilizes a supplemental utility fluid, which is generally added to the combined streams of line 350 via conduit 330. The combined stream, a tar-fluid mixture which is primarily in the liquid phase, is conducted to a supplemental pre-heat stage 90 via conduit 370. The supplemental pre-heat stage can be, e.g., a fired heater. Recycled treat gas is obtained from conduit 265. If needed, fresh treat gas, comprising molecular hydrogen, can be obtained from conduit 131. The treat gas is conducted via conduit 60 to a second pre-heat stage 360, the heated treat gas being conducted to the supplemental pre-heat stage 90 via conduit 80. The pre-heated tar-fluid mixture (from line 380) is combined with the pre-heated treat gas and then conducted via line 100 to hydroprocessing stage 110. Mixing means are utilized for combining the pre-heated tar-fluid mixture with the pre-heated treat gas in hydroprocessing stage 110, e.g., one or more gas-liquid distributors of the type conventionally utilized in fixed bed reactors. The SCT is hydroprocessed in the presence of the utility fluid, supplemental utility fluid, the treat gas, and hydroprocessing catalyst.

Figure 3:
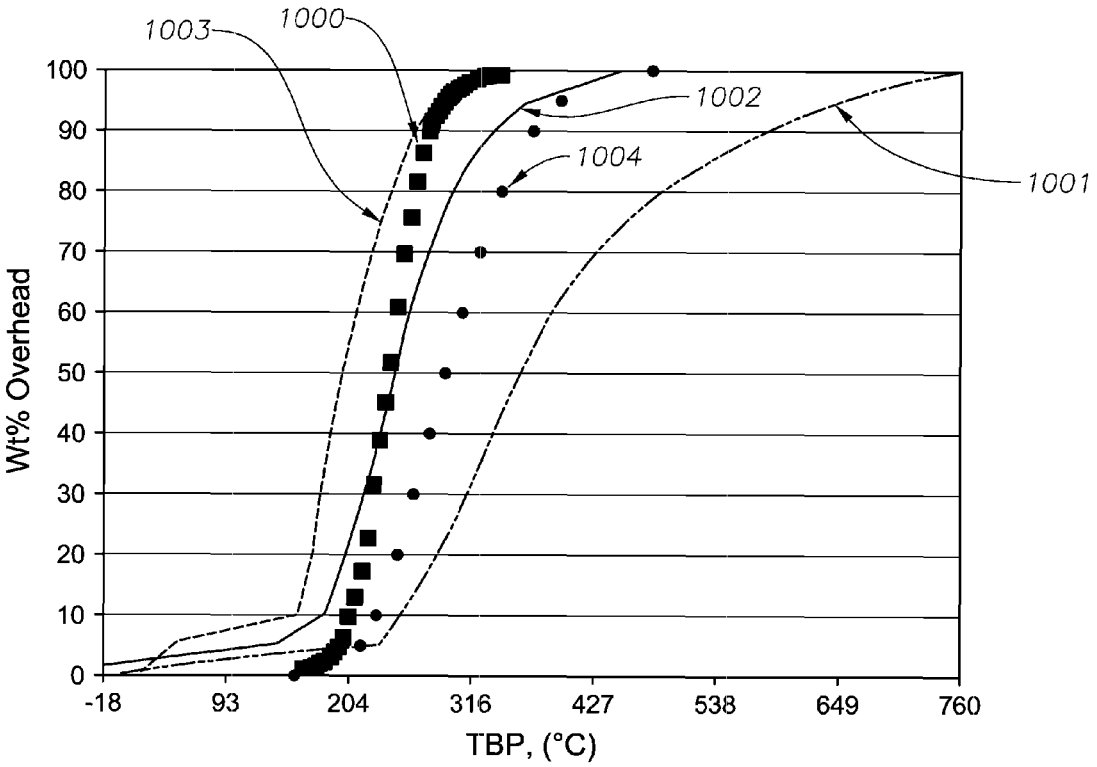
FIG. 3 is a graphical representation of the boiling point distributions for selected utility fluids.

Hydroprocessed product is conducted away from stage 110 via conduit 120. When the tar-fluid mixture preheat stage 70 and the treat gas preheater stage 360 are heat exchangers, the heat transfer is indirect. Following these stages, the hydroprocessed product is conducted to separation stage 130 for separating total vapor product (e.g., heteroatom vapor, vapor-phase cracked products, unused treat gas, etc.) and total liquid product (e.g., hydroprocessed tar) from the hydroprocessed product. A product overhead mixture (comprising the total vapor product of stage 130) is conducted via line 200 to upgrading stage 220, which comprises, e.g., one or more amine towers. Fresh amine is conducted to stage 220 via line 230, with rich amine conducted away via line 240. Upgraded treat gas is conducted away from stage 220 via line 250, compressed in compressor 260, and conducted for via line 265, 60, and 80 for re-cycle and re-use in the hydroprocessing stage 110. Fresh treat gas, e.g., for starting up the process or for make-up, is obtained from line 131. A product bottoms mixture, comprising the total liquid product of stage 130, is divided into first and second portions. The first portion is conducted away from stage 130 via line 270A to pump 300, with the pump effluent conducted away via line 310. The second portion is conducted via line 270B to a second separation stage 280, for separating a product liquid stream (conducted away via line 134) and a product vapor stream (conducted away via line 290). Curve 1001 of FIG. 3 represents a boiling point curve of the utility fluid produced from the liquid bottoms of separation stage 130 of the prior-art method of recycling a portion of the bottoms of the total hydroprocessed product (shown in FIG. 2). As indicated, greater coking occurs in the pre-heat stages 90, 70 and hydroprocessing stage 110 when a bottoms recycle is used as utility fluid, as shown in FIG. 2. It is conventional to lessen this effect by combining the utility fluid with a supplemental utility fluid, supplied via line 330.

Certain aspects of the invention are based on two discoveries: (i) a utility fluid composition and boiling range has been found that significantly lessens the amount of fouling in the hydroprocessing reactor and ancillary equipment, resulting in increased hydroprocessing run length, and (ii) the desired utility fluid can be obtained from the hydroprocessor effluent with little or no need for supplemental utility fluid.

Concerning the first discovery, it has been found that that there is a beneficial decrease of coke formation in one or more of the pre-heat stages 90, 70, and/or hydroprocessing stage 110 when the utility fluid comprises aromatics and has a final boiling point ≤430° C. (800° F.). Pyrolysis tar hydroprocessing is particularly advantageous when the utility fluid is one which (i) comprises ≥25.0 wt. % of 1-ring and 2-ring aromatics (i.e., those aromatics having one or two rings and at least one aromatic core), based on the weight of the utility fluid, and (ii) has a final boiling point ≤430° C. (800° F.), preferably ≤400° C. (750° F.). Representative utility fluids having (i) at least the minimum desired aromatics content and (ii) a desirable boiling point distributions, are shown as distributions 1000, 1002, 1003, and 1004 in FIG. 3. The distributions shown in FIG. 3 are true boiling point distributions ("TBP", the distribution at atmospheric pressure). A true boiling point distribution can be determined, e.g., by conventional methods such as the method of ASTM D7500. When the final boiling point is greater than that specified in the standard, the true boiling point distribution can be determined by extrapolation. Suitable utility fluids include those where ≥90.0 wt. % of the utility fluid has an atmospheric boiling point ≥300° F. (150° C.), e.g., ≥325° F. (163° C.), such as ≥350° F. (175° C.); and ≤10.0 wt. % of the utility fluid has an atmospheric boiling point ≥800° F. (430° C.), e.g., ≥775° F. (413° C.), such as ≥750° F. (400° C.). Optionally, the utility fluid is one where ≥95.0 wt. % of the utility fluid has an atmospheric boiling point ≥300° F. (150° C.), e.g., ≥325° F. (163° C.), such as ≥350° F. (175° C.); and ≤5.0 wt. % of the utility fluid has an atmospheric boiling point ≥800° F. (430° C.), e.g., ≥775° F. (413° C.), such as ≥750° F. (400° C.). Typically, the utility fluid has a true boiling point distribution having (i) an initial boiling point ≥300° F. (150° C.), e.g., ≥325° F. (163° C.), such as ≥350° F. (175° C.), and (ii) a final boiling point ≤800° F. (430° C.), e.g., ≤775° F. (413° C.), such as ≤750° F. (400° C.); e.g., having a true boiling point distribution in the range of from 175° C. (350° F.) to about 400° C. (750° F.). It is believed that utilizing a utility fluid having a final boiling point >430° C. leads to an increase in fouling (e.g., coking) in the reactor and/or preheat equipment, even when such utility fluids have more than the desired minimum aromatic content (≥25.0 wt. % of 1-ring and 2-ring aromatics, based on the weight of the utility fluid). Since it is believed that the increased non-aromatic content of utility fluids having a relatively low initial boiling point, such as those where ≥10 wt. % of the utility fluid has an atmospheric boiling point <175° C., can lead to STC-utility fluid incompatibility and asphaltene precipitation, the utility fluid optionally has an initial boiling point ≥175° C. The curves of FIG. 3 are representative only, as the actual curves are dependent on SCT composition and boiling range.

Concerning the second discovery, certain aspects of the invention relate to the development of tar hydroprocessing processes which need less (or no) supplemental utility fluid to operate long-term with less reactor fouling than is the case in conventional pyrolysis tar processing. It is conventional, as shown in FIG. 2, to combine the recycled portion of the total liquid bottoms of separator 130 with a supplemental utility fluid. It is observed that combining contents of line 270A with a supplemental utility fluid obtained from an external source via line 330 can provide a boiling point distribution for the recycled utility fluid+supplemental utility fluid substantially similar to that of curve 1000 in FIG. 3, e.g., when the supplemental utility fluid comprises substantially 100.0 wt. %, based on the weight of the supplemental utility fluid, of 1-ring and 2-ring aromatics having an atmospheric boiling point ≤400° C. In certain aspects, such as those illustrated schematically in FIGS. 4-7, the desired utility fluid is obtained from the hydroprocessor effluent, with less or no need for supplemental utility fluid to achieve the desired composition and boiling point distribution.

Accordingly, certain aspects of the invention relate to further distillation, separation, or stabilization of that portion of the total liquid product used as a utility fluid (the fluid delivered via line 270) to lessen the amount of coking in the hydroprocessing reactor and/or pre-heat stages 90 and 70. For example, an aromatics-containing stream can be separated from the product bottoms mixture, e.g., in a second separation stage that is in fluid communication with first separation stage 130 via line 270. Separation stage 130 can include conventional separation means, e.g., one or more vapor-liquid separators, such as one or more flash drums, but the invention is not limited thereto. An aromatics-containing stream is removed from the second separation stage, e.g., as a side stream (also called a "side-cut"), the aromatics-containing stream having a diminished content of heavy hydrocarbon molecules compared to the fluid of line 270. While not wishing to be bound by any theory or model, it is believed that the need for a supplemental utility fluid is lessened or eliminated because the separated aromatics-containing stream contains fewer coke precursors and/or foulant (or foulant precursors) than does the fluid of line 270. As shown schematically in FIG. 4, the product bottoms mixture can be conducted via line 270 to the second separation stage 280, for separating from the product bottoms mixture (i) a side-cut (line 20) for use as the utility fluid having the desired characteristics; (ii) a product vapor stream (line 290, comprising, e.g., heteroatom gases, gaseous cracked products, unused treat gas, etc.); and (iii) a product liquid stream (line 134). The product liquid stream can be utilized as a fuel oil, e.g., a heavy fuel oil. Alternatively or in addition, the product liquid stream can be blended with a second hydrocarbon, e.g., a heavy hydrocarbon, such as fuel oil and/or heavy fuel oil. Advantageously, the product liquid stream has desirable blending characteristics, e.g., when blended with asphaltene-containing heavy oils, the resulting blend contains fewer precipitated particulates (such as fewer precipitated asphaltenes) than do blends of the pyrolysis tar feed with the same heavy oil. Other liquid by-products, not shown, can also be conducted away from stage 280 if desired. One or more conventional fractional distillation columns can be used for the separation in stage 280, but the invention is not limited thereto. The utility fluid is conducted away from the second separation stage 280 via line 20 to pump 300. SCT from line 65 is combined with the pump effluent 310 to produce the tar-fluid mixture. In other respects, the process of FIG. 4 operates similar to the process shown in FIG. 2, with similar features identified by the same index numbers. For example, in certain aspects heating stage 90 can include at least one fired heater, e.g., for exposing the tar-fluid mixture in line 370, and/or the treat gas in line 80, to a temperature ≥300° C. before the hydroprocessing, typically in the range of 300° C. to 500° C.

Those skilled in the art of hydrocarbon separations will appreciate that a side-cut utility fluid of line 20 can be configured to comprise ≥25.0 wt. % of 1-ring and 2-ring aromatics, based on the weight of the side-cut, such as ≥50.0 wt. % of 1-ring and 2-ring aromatics. The utility fluid of line 310 can comprise at least a portion of this side-cut, aromatics-containing stream, e.g., ≥50.0 wt. % of the side-cut aromatics-containing stream based on the weight of the utility fluid, e.g., ≥75.0 wt. %, such as ≥90.0 wt. %, or substantially all of the side-cut aromatics-containing stream conducted away from stage 280 via line 20. The remainder of the side-cut aromatics-containing stream of line 20 (the part, if any, that is not utilized as utility fluid), can be conducted away from the process for storage or further processing. The side-cut can have, e.g., 10% (weight basis) true boiling point ≥175.0° C. and a 90% (weight basis) true boiling point ≤400.0° C.

A representative side-cut aromatics-containing stream, one that is suitable for use as utility fluid, has a boiling point distribution represented as curve 1003 in FIG. 3. As can be seen, the boiling point curve of this side-cut aromatics-containing stream has an overall boiling point distribution that is lower than that of the bottom feed recycle (curve 1001) of the prior art process. Separation allows the side-cut to have a diminished content of coke precursors, foulant, and/or foulant precursors that, if otherwise present in greater concentration, would lead to increased pressure drops in the process's pre-heat and hydroprocessing stages. Using a utility fluid which contains a stabilized stream, e.g., the side-cut of line 20 of FIG. 4, has been found to provide, e.g., longer hydroprocessing run lengths and less coking than is the case when using a utility fluid containing substantially the same amount of a stream obtained from FIG. 2, line 270A. Hydroprocessing run lengths are generally ≥one month ($2.67\times10^6$ seconds), e.g., ≥six months ($1.6\times10^7$ seconds), such as ≥one year ($3.2\times10^7$ seconds), or even ≥three years ($9.6\times10^7$ seconds). The pressure drop across hydroprocessing stage 110 is the primary factor in hydroprocessing run length, with hydroprocessing run length being defined as the duration of time on-stream during which the pressure drop across stage 110 increases from an initial value at start-up to a value that is two times the initial value or more, e.g., three times the initial value or more. It has also been observed that this increased run length benefit is obtained over a wide range of reactor operating conditions, e.g., a total pressure ≥34 bar absolute (500 psia), such as in the range of 68 bar absolute (1000 psia) to 102 bar absolute (1500 psia); catalyst bed temperature ≥315° C. (600° F.), such as in the range of from about 400° C. (750° F.) to about 425° C. (800° F.), and a utility fluid:SCT weight ratio ≥0.01, e.g., in the range of 0.05 to 4.0, such as in the range of 0.1 to 3.0, or 0.3 to 1.1. It is observed that a supplemental utility fluid may be needed under certain operating conditions, e.g., when starting the process (until sufficient utility fluid is available from the hydroprocessor effluent), or when operating at higher reactor pressures. It is desired to obviate the need for the supplemental utility fluid when operating the hydroprocessing stage at elevated pressures, such as a total pressure ≥68 bar absolute (1000 psia), particularly in continuous operation.

Accordingly, a supplemental utility fluid, such as a solvent, a solvent mixture, SCN, steam cracked gas oil (SCGO), or a fluid comprising aromatics (i.e., comprises molecules having at least one aromatic core) may optionally be added via conduit 330, e.g., to start-up the process. In certain aspects, the supplemental utility fluid comprises ≥50.0 wt. %, e.g., ≥75.0 wt. %, such as ≥90.0 wt. % of aromatics, based on the weight of the supplemental utility fluid, the aromatics having an 10% true boiling point ≥60° C. and a 90% true boiling point ≤360° C. Optionally, the supplemental utility fluid has a 10% true boiling point ≥120° C., e.g., ≥140° C., such as ≥150° C. and/or an 90% true boiling point ≤430° C., e.g., ≤400° C. Optionally, the supplemental utility fluid comprises ≥90.0 wt. % based on the weight of the utility fluid of one or more of benzene, ethylbenzene, trimethylbenzene, xylenes, toluene, naphthalenes, alkylnaphthalenes (e.g., methylnaphthalenes), tetralins, or alkyltetralins (e.g., methyltetralins), e.g., ≥95.0 wt. %, such as ≥99.0 wt. %. It is generally desirable for the supplemental utility fluid to be substantially free of molecules having alkenyl functionality, particularly in aspects utilizing a hydroprocessing catalyst having a tendency for coke formation in the presence of such molecules. In certain aspects, the supplemental utility fluid comprises ≤10.0 wt. % of ring compounds having $C_1$-$C_6$ sidechains with alkenyl functionality, based on the weight of the utility fluid. One suitable supplemental utility fluid is A200 solvent, available from ExxonMobil Chemical Company (Houston Tex.) as Aromatic 200, CAS number 64742-94-5.

Figure 4:
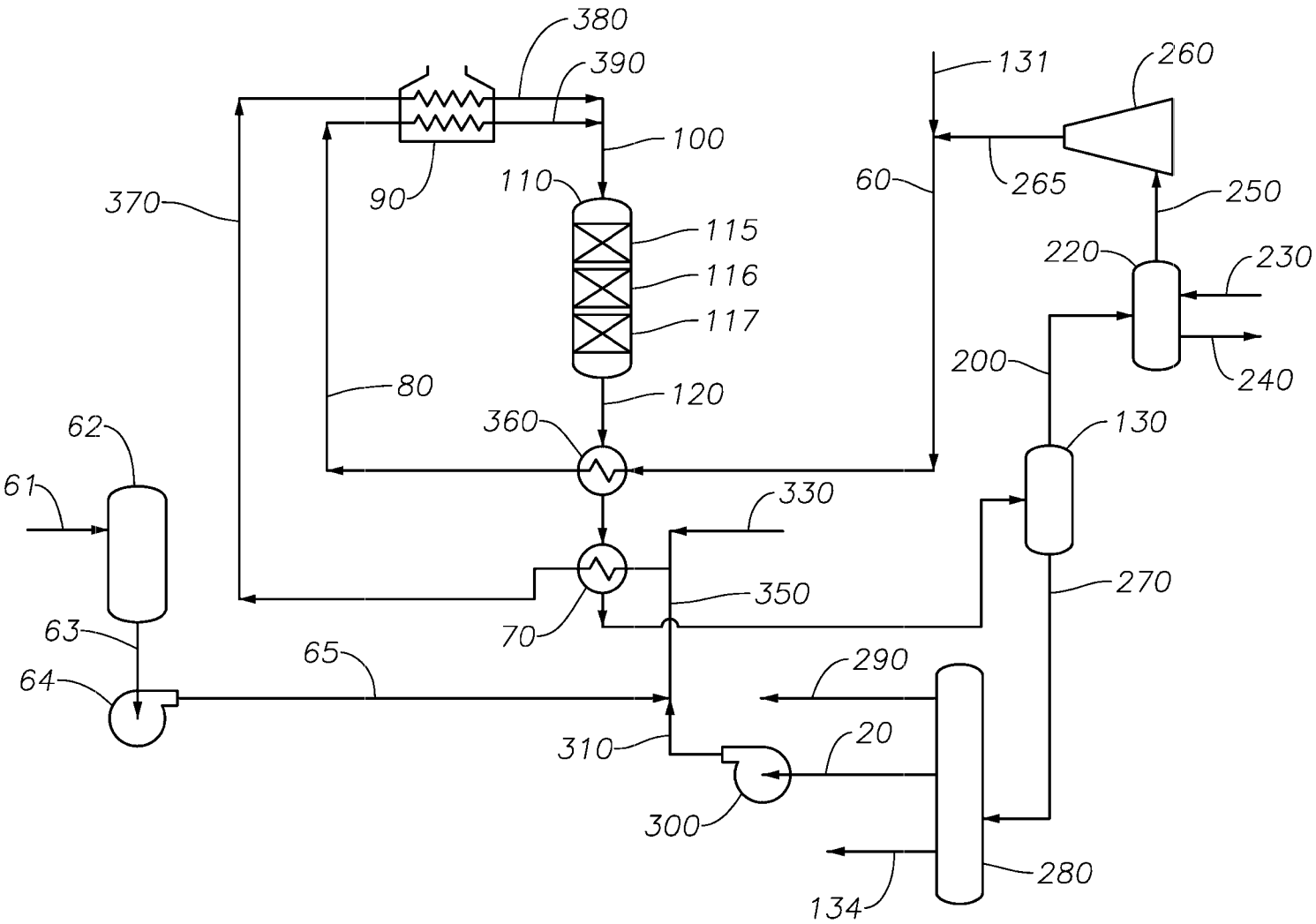
FIG. 4 is a processing schematic of certain aspects of the invention which include SCT hydroprocessing in the presence of a utility fluid. The utility fluid comprises a recycled side stream obtained by fractionating a bottoms portion of the hydroprocessed product.
Figure 5:
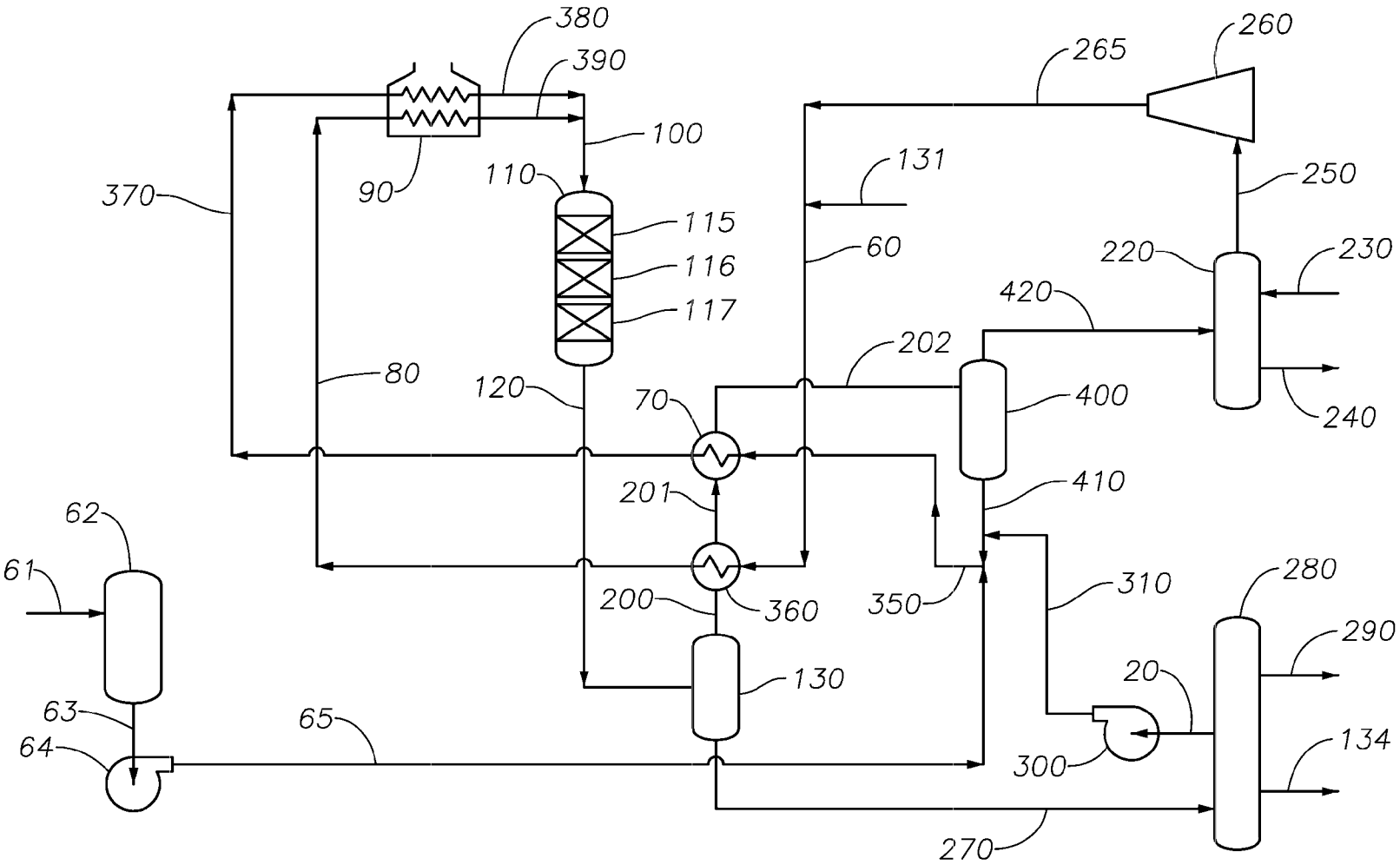
FIG. 5 is a processing schematic of related aspects of the invention, which include hydroprocessing SCT in the presence of a utility fluid, the utility fluid comprising first and optionally second components. The first component comprises a bottoms stream obtained from condensed hydroprocessed product. The optional second component comprises a side stream obtained by fractionating hydroprocessed product.

Certain aspects of the invention are based on the discovery that the amount of supplemental utility fluid can be further decreased or even eliminated, even when the hydroprocessing is operated at a total pressure ≥68 bar absolute (1000 psia), when the utility fluid comprises (or consists of, or consists essentially of) (a) a first component that is separated from the product overhead mixture and optionally (b) a second component that is separated from the product bottoms mixture. When both components are used, the utility fluid is a "combined" utility fluid. In certain aspects, illustrated schematically in FIG. 5, the second component of the utility fluid is obtained by separating in stage 280 a side-cut aromatics-containing stream from the product bottoms mixture. As shown in FIG. 5, a fluid stream, primarily in the liquid phase and comprising the bottoms of first separation stage 130, is conducted to separation stage 280 via line 270. For ease of reference, features of FIG. 5 that are substantially similar to those of FIG. 4 are identified by the same index numbers. The first component is produced from the product overhead mixture by relocating pre-heat stages 70 and 360. Instead of transferring heat from the hydroprocessed product of line 120 (as in FIGS. 2 and 4), heat is transferred from the product overhead mixture (line 200) in pre-heat stage 360 (via lines 200 and 201) and pre-heat stage 70 (via lines 201 and 202). This relocation of the pre-heating stages results in a greater mass flow rate of the vapor phase (the product overhead mixture) in line 200, and a lesser mass flow rate of the liquid phase (the product bottoms mixture) that is conducted in line 270. Cooling of the vapor of lines 200 and 201 in stages 360 and 70 condenses a portion of the product overhead mixture into the liquid phase, which is separated from the remaining vapor in a third separation stage 400. Separation stage 400 can include conventional separation means, e.g., one or more vapor-liquid separators, such as one or more flash drums, but the invention is not limited thereto. It is observed that when a representative tar-fluid mixture in line 370 and a representative recycle gas in line 80 are indirectly preheated by transferring heat from the product overhead mixture, the liquid bottoms withdrawn from stage 400 has a true boiling point distribution in the range of from 93° C. (200° F.) to 371° C. (700° F.). The vapor overhead from stage 400 (a spent treat gas mixture) is conducted away via line 420, and can be processed (e.g., for treat gas upgrading and recycling) in a similar manner to that utilized in the process configuration illustrated in FIG. 4. For example, separated vapor can be conducted away from stage 400 via line 420, for treat gas recovery and upgrading. One or more amine towers 220 can be used for removal of acid-gas components such as $H_2S$ and $CO_2$. Fresh aqueous amine is conducted to stage 220 via line 230. Rich aqueous amine is conducted away from stage 220 via line 240. The upgraded vapor (regenerated treat gas) is conducted away from stage 220 via line 250, e.g., for recycling to the process. Compressor 260 can be utilized for increasing recycled treat gas pressure, with the high-pressure treat gas recycled to the process via line 265. Supplemental fresh treat gas can be provided via line 131 if needed. Should more treat gas be available for recycle than is needed for the process, valve means (not shown) can be utilized for diverting at least a portion of the treat gas, spent treat gas mixture, or regenerated treat gas away from the process, e.g., from lines 420 and/or 250.

A condensate, (e.g., a fluid withdrawn from drum bottoms) can be conducted away from stage 400 via line 410, for use, e.g., as the combined utility fluid's first component. When processing representative SCT, the condensate's true boiling point distribution typically has an initial boiling point ≤400° C. (more preferred ≤350° C.), the condensate comprising ≥50.0 wt. % of one-ring aromatics and/or two-ring aromatics, based on the weight of the condensate. The combined utility fluid's first component (obtained from line 410), the combined utility fluid's second component (obtained from line 310), and the SCT (of line 65) can be mixed (in any order) upstream of pre-heat stage 70.

It is observed that it is easier to keep representative SCTs in solution when the combined utility fluid's first component forms the majority of the combined utility fluid. In certain aspects, therefore, the combined utility fluid comprises 10.0 wt. % to 40.0 wt. % of the second component and 60.0 wt. % to 90.0 wt. % of the first component, based on the weight of the combined utility fluid, the combined utility fluid having a 10% boiling point ≥175° C. and a final boiling point ≤430° C. Since the 10% boiling point is at least 175° C., the amount of non-aromatics in the combined utility fluid is less than that which would otherwise cause an undesirable amount of asphaltene precipitation, which can lead to increased fouling. Since the combined utility fluid has a final boiling point that is ≤430° C., it contains fewer high-molecular weight molecules than does the utility fluid of the process configuration shown in FIG. 2. Excluding at least a portion of these high molecular-weight molecules, as in the aspects illustrated in FIG. 5, lessens coking in pre-heat and reactor components during hydroprocessing. This benefit is obtained even at a total pressure in stage 110 of ≥68 bar (1000 psia). Valve means (not shown), for example, can be utilized for adjusting the weight ratio of second component: first component in the combined utility fluid. Amounts of first and second components beyond that needed to produce the combined utility fluid can be conducted away from the process, e.g., for storage or further processing, such as for further separation in stage 280. The liquid feed mixture to the hydroprocessing reactor (combined utility fluid plus SCT) can comprise 20-95% of SCT and 5 wt. % to 80 wt. % of combined utility fluid, the weight percents being based on the weight of the liquid feed mixture, for example, 40 wt. % to 45 wt. % of combined utility fluid and 55 wt. % to 60 wt. % of SCT. In certain aspects, the utility fluid is a combined utility fluid, the combined utility fluid comprising (or consisting essentially of, or consisting of) the first and second utility fluid components, (ii) wherein the mass ratio of [1-ring aromatics+2-ring aromatics]:saturated hydrocarbon molecules in the combined utility fluid is increased over that of the second component by a factor ≥1.5, (iii) the first utility fluid component has a final boiling point ≤400° C. (750° F.), and (iv) the second utility fluid component has a final boiling point about 400° C.

While not wishing to be bound by any theory or model, it is believed that relocating pre-heaters 70 and/or 360 as shown in FIG. 5 increases the vapor-phase mass flow rate in line 200, leading to an increase in 1-ring aromatics and 2-ring aromatics in the vapor effluent from separation stage 130. Condensing and separating at least a portion of these 1-ring and 2-ring aromatics in separation stage 400 produces a condensate, conducted away from stage 400 via line 410, that has a greater content of 1-ring aromatics and 2-ring aromatics and a lower final boiling point than that of curve 1001 in FIG. 3. Combining the first and second components of the utility fluid therefore (i) moves the combined utility fluid's true boiling point distribution toward the left hand side of FIG. 3, i.e., away from curve 1001 and towards curve 1000.

The combined utility fluid has fewer high-molecular weight compounds having an atmospheric boiling point ≥400° C. (750° F.), e.g., ≥430° C., that might otherwise cause fouling. In a related configuration, illustrated schematically in FIG. 6, the vapor product of separation stage 400 is further processed in a fourth separation stage 450. Separation stage 450 can include conventional separation means, e.g., one or more vapor-liquid separators, such as one or more flash drums, but the invention is not limited thereto. Vapor conducted away from stage 400 via line 420 is subjected to additional cooling in condenser 430, with the resulting vapor-condensate conducted to separation stage 450 via line 440. A vapor-phase stream is separated from the vapor-condensate in stage 450, and is conducted away from stage 450 via line 460. The vapor conducted away via line 460 can be treated (e.g., for treat gas upgrading and recycling) in a similar manner to that described in connection with the process configurations illustrated in FIGS. 2, 4, and 5 (with like index numbers corresponding to like process features). A liquid phase separated in stage 450 is conducted away via line 470. Heat is indirectly transferred to the liquid phase in line 470 in stage 202*a*, with the heated liquid phase being conducted away via line 480. The heated liquid phase is combined with the liquid phase separated in stage 130. The combined liquid streams are conducted to second separation stage 280 via line 490. Separator 450 condenses light hydrocarbons increasing the hydrogen purity of the recycle gas and increases hydrogen partial pressure in the reactor. Liquid conducted away from stage 400 via line 410 can be utilized as the first component of the combined utility fluid. Liquid condensed in condenser 430 is separated in stage 450. The separated liquid is conducted to stage 280 via lines 470, 480, and 490. In certain aspects, the amount of product liquid stream obtained from the process is substantially the same as the amount of product liquid stream conducted away in line 134 when the process is operated in the configurations illustrated in FIG. 4 or 5 (when substantially the same SCT composition and hydroprocessing conditions are used). In other words, the primary purpose of stages 430 and 450 is to purify molecular hydrogen in the recycle gas and lessen hydrocarbon losses to the recycle purge (not shown).

Figure 6:
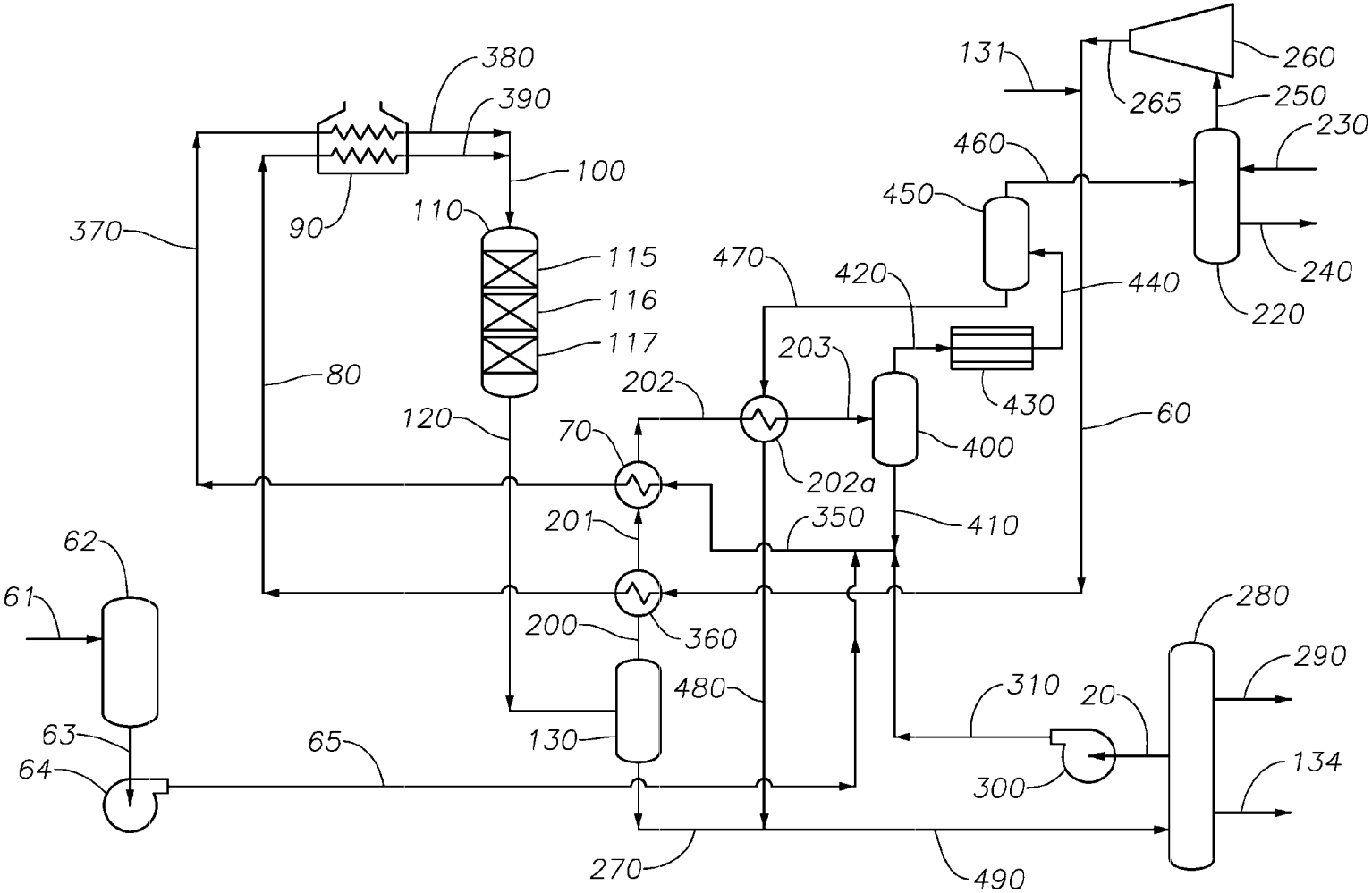
FIG. 6 is the processing schematic of FIG. 5, further including augmenting the feed to the fractionator of FIG. 5 with a second bottoms portion of the hydroprocessed product.

When the utility fluid is produced in accordance with the process configurations of FIG. 5 or 6, typically ≥80.0 wt. % of the utility fluid in the tar-fluid mixture (line 370) is obtained from line 410, with ≤20.0 wt. % of the utility fluid in the tar-fluid mixture being obtained from line 20. In this process configuration, where the separator side cut similar to that of curve 1003, and the bottoms of the separator stage 400 has an atmospheric boiling range of about 93° C. (200° F.) to 371° C. (700° F.), the combined utility fluid is observed to have (i) ≥50.0 wt. % of 1-ring and 2-ring aromatics and (ii) the true boiling point distribution depicted as the curve 1002 of FIG. 3, which approximates the desired true boiling point distribution of curve 1000. Alternatively, in aspects not shown in the figure, substantially all of the utility fluid in the tar-fluid mixture is obtained from line 410. Advantageously, a supplemental utility fluid is not needed in any of these configurations.

Figure 7:
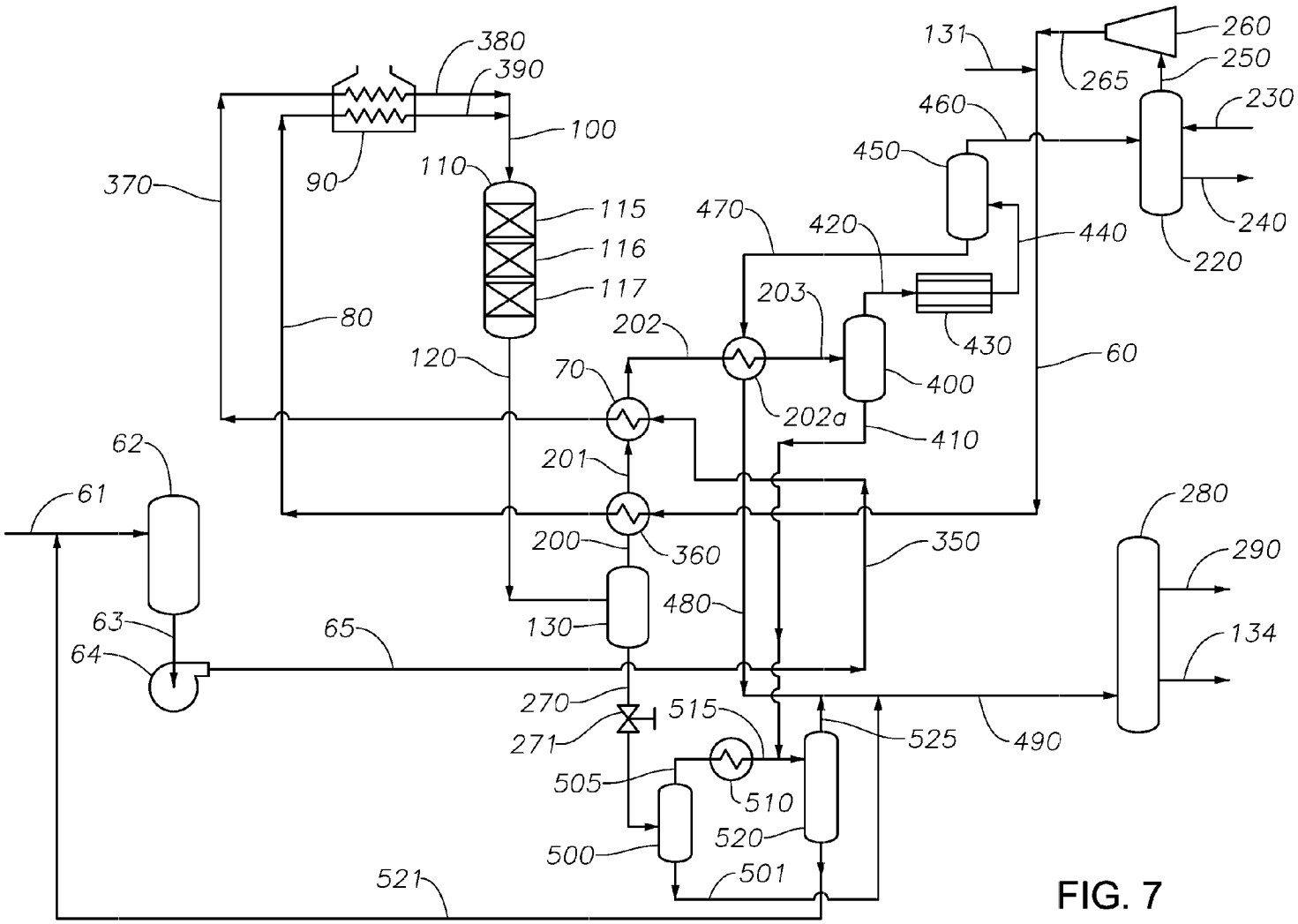
FIG. 7 is a processing schematic of aspects which include additional separations.

In other aspects of the invention, such as those illustrated schematically in FIG. 7, additional separation stages are utilized to produce a more desirable utility fluid by lessening the amount of utility fluid compounds having an atmospheric boiling point ≤175° C. In other respects, these aspects operate in substantially the same way as that illustrated in FIG. 6, with similar features identified by the same index numbers.

As shown in FIG. 7, the liquid bottoms of stage 130 are conducted via line 270 to valve 271, resulting in a pressure decrease of the stage 130 bottoms downstream of valve 271, which leads to vaporization of at least a portion of the bottoms. The bottoms are then conducted to separation stage 500 (e.g., one or more flash drums). Stage 500 bottoms are conducted to stage 280 via conduit 501. Vapor conducted away from stage 500 via line 505 is cooled in heat exchange stage 510, to condense at least a portion of the vapor into a liquid phase. The vapor and condensed liquid are then conducted via conduit 515 to separation stage 520 (e.g., one or more flash drums). Liquid removed from stage 520 via conduit 521, which is suitable for use as utility fluid, has a true boiling point distribution represented by curve 1004 of FIG. 3. As can be seen from the boiling point distribution, utility fluid obtained from line 521 desirably contains fewer compounds having an atmospheric boiling point <175° C. (cf. curves 1000, 1003, and 1002) and fewer compounds having an atmospheric boiling point >400° C. (cf. curve 1001). Vapor obtained from stage 520 can be conducted to stage 280 via conduit 525, or alternatively (not shown) combined with the contents of conduit 501 upstream of stage 280. SCT (conduit 61) can be combined with the utility fluid of line 521 upstream of stage 62, as shown in FIG. 7. If desired, means for increasing the pressure of the utility fluid of line 521, e.g., one or more pumps (not shown), can be utilized for conducting the utility fluid to a point upstream of stage 62 for combining with the SCT. The bottoms of stage 400 are combined with the contents of line 505 downstream of heat exchange stage 510 to increase the amount of utility fluid conducted away via line 521.

Should the liquid conducted away from stage 521 be present in a greater amount than is needed for use as utility fluid, the remainder can be removed from line 521, for storage, further processing, or return to the process at or upstream of the inlet to stage 280. Besides producing a more desirable utility fluid, the aspects of the invention illustrated in FIG. 7 are believed to be less costly and more efficient than those shown in FIGS. 4-6 by obviating the need for a utility fluid component from stage 280.

For a reactor 110 operating under substantially constant hydroprocessing conditions to hydroprocess an SCT of substantially constant composition, the mass rate of coke production is considerably lessened over the conventional process when the utility fluid is produced as described in connection with the process configurations of FIGS. 4-7. In certain aspects, shown in FIG. 4, ≥10.0 wt. %, e.g., ≥50.0 wt. %, such as ≥90.0 wt. % of the utility fluid that is contained in the tar-fluid mixture (line 370) is obtained from line 20, based on the weight of the utility fluid in the tar-fluid mixture, such as ≥75.0 wt. %, or ≥90.0 wt. %. The balance of the utility fluid can be obtained from line 330. In other aspects (not shown), ≥10.0 wt. %, e.g., ≥50.0 wt. %, such as ≥90.0 wt. %, or 95.0 wt. % of the utility fluid in the tar-fluid mixture, or even substantially all of the utility fluid in the tar-fluid mixture, is obtained from line 410. The balance of the utility fluid, can be e.g., supplemental utility fluid. In other aspects, shown in FIGS. 5 and 6, ≥10.0 wt. %, e.g., ≥50.0 wt. %, such as ≥90.0 wt. %, or even substantially all of the utility fluid that is contained in the tar-fluid mixture (line 370) comprises first and second components, the first component being obtained from line 410 and the second component being obtained from line 310. The second component:first component weight ratio being in the range of from about 0.0 to about 0.9, such as from 0.11 to 0.67. Valve means, not shown in the figures, can be utilized for transferring the desired amounts of first and/or second components to line 370. In other aspects, shown in FIG. 7, ≥50.0 wt. % of the utility fluid present in the tar-fluid mixture is obtained from line 521, based on the weight of the tar-fluid mixture, such as ≥75.0 wt. %, or ≥90.0 wt. %.

In any of the preceding aspects, the hydroprocessing can be carried out under pyrolysis tar hydroprocessing conditions, including a reactor operating temperatures ≤500° C., e.g., ≤415° C., such as in the range of from 200.0° C. to 450.0° C.; reactor operating pressures ≤1500 psig (100 bar (g)), e.g., ≤1000 psig (67 bar (g)); a pyrolysis tar feed rates ≥400 kta, e.g., in the range of from about 425 kta to about 650 kta; and molecular hydrogen consumption rate ≤2500 SCF/B of pyrolysis tar (445 standard cubic meters of molecular hydrogen per cubic meter of tar, "S $m^3/m^3$), e.g., ≤1500 SCF/B (267 S $m^3/m^3$) of pyrolysis tar, such as in the range of from about 600 SCF/B (107 S $m^3/m^3$) to about 1500 SCF/B of pyrolysis tar (267 S $m^3/m^3$). Molecular hydrogen for the hydroprocessing is generally made available to the process as one component of a treat gas, the treat gas comprising, e.g., ≥70.0 mole % of molecular hydrogen per mole of the treat gas. The hydroprocessing is generally operated at a utility fluid:pyrolysis tar weight ratio ≥0.01, e.g., in the range of 0.05 to 4.0, such as in the range of 0.1 to 3.0, or 0.3 to 1.1. Molecular hydrogen is typically supplied to the hydroprocessing stage at a rate about 300 standard cubic feet of molecular hydrogen per barrel ("SCF/B"), where B refers to barrel of raffinate fed to the hydroprocessing stage, to 5000 SCF/B. This corresponds to 53 standard cubic meters of molecular hydrogen per cubic meter of raffinate (S $m^3/m^3$) to 890 S $m^3/m^3$. For example, the molecular hydrogen can be provided in a range of from 1000 SCF/B (178 S $m^3/m^3$) to 3000 SCF/B (534 S $m^3/m^3$). Valve means, not shown in the figures, can be utilized for transferring the desired amounts of SCT and utility fluid (or one or more utility fluid components) to the hydroprocessing reactor, e.g., by transferring the desired amounts of SCT and utility fluid to line 370 in FIGS. 4-7.

When the tar-fluid mixture (e.g., the feed conducted via line 370 in FIGS. 4-7) comprises, or consists essentially of, or consists of [utility fluid+SCT], the amount of utility fluid in the tar-fluid mixture can be, e.g., in the range of from about 5.0 wt. % to about 80.0 wt. %, based on the weight of the tar-fluid mixture, e.g., in the range of from about 40.0 wt. % to about 60.0 wt. %. When the pyrolysis tar comprises (or consists essentially of, or consists of) SCT, e.g., ≥75.0 wt. %, e.g., ≥90.0 wt. %, such as ≥99.0 wt. % SCT, the hydroprocessing conditions can include a reactor temperature in the range of 300° C. to 500° C., such as 350° C. to 415° C., and a reactor pressure in the range of 34 bar absolute (500 psia) to 135 bar absolute (1960 psia), e.g., 68 bar (absolute) to 102 bar (absolute). Molecular hydrogen consumption rate is generally ≤267 S $m^3/m^3$, such as in the range of from 107 S $m^3/m^3$ to 214 S $m^3/m^3$.

The hydroprocessing can be catalytic hydroprocessing, carried out in the presence of one or more hydroprocessing catalysts. Conventional hydroprocessing catalyst can be utilized, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more aspects, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. In one or more aspects, the catalyst is a bulk multimetallic hydroprocessing catalyst with or without binder. In an aspect the catalyst is a bulk trimetallic catalyst comprised of two Group 8 metals, preferably Ni and Co and the one Group 6 metals, preferably Mo. Conventional hydrotreating catalysts can be used, but the invention is not limited thereto. In certain aspects, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pre-treat catalyst, such as DN3651 and/or DN3551, available from the same source. However, the invention is not limited to only these catalysts.

Referring again to FIGS. 4-7, the hydroprocessing catalyst being deployed within hydroprocessing stage 110 in catalyst beds 115, 116, and 117. Additional or fewer catalyst beds can be used if desired. Inter-stage cooling and/or quenching can be used, e.g., using treat gas, from line 60 provided between beds. Alternatively, additional utility fluid can be utilized for cooling and/or quenching, particularly if the tar-fluid mixture (line 370) is relatively lean in utility fluid.

The amount of coking in the hydroprocessing reactor (e.g., reactor 110 of the configurations illustrated schematically in FIGS. 4-7) is relatively small and run lengths ≥10 days, or ≥100 days, or even ≥500 days are observed without an increase in reactor pressure drop of ≥10.0% over its start-of-run ("SOR") value, as calculated by ([Observed pressure drop−Pressure $drop_{sor}$]/Pressure $drop_{sor}$)*drop 100%. However, sub-optimal operating conditions, e.g. process upsets, can make reactor decoking desirable. In conventional resid hydroprocessing, whether in the presence of a diluent or otherwise, reactor decoking can be a significant undertaking, including, e.g., hydro-blasting, disassembly and re-assembly of reactor components, catalyst rejuvenation and/or replacement, etc. For SCT hydroprocessing in accordance with the invention, it has been found that (i) the coke formed in the hydroprocessing reactor is at least weakly soluble in the utility fluid or combined utility fluid, e.g., coke formed when operating hydroprocessing reactor 110 in one or more of the process configurations illustrated in FIGS. 4-7. It has also been found that the amount of utility fluid in the configuration of FIG. 7 (and that of the combined utility fluid in the configurations of FIGS. 5 and 6) is typically greater than the amount needed to fully solubilize the SCT in reactor 110, even at reactor pressures ≥68 bar absolute (1000 psia).

In certain aspects, ≥1.0 wt. % of the utility fluid (or combined utility fluid) in line 350 is diverted away from the process to storage, e.g., by valve means (not shown). For example, ≥5.0 wt. %, such as ≥10.0 wt. %, or even ≥20.0 wt. % of the utility fluid (or combined utility fluid) of line 350 can be diverted to storage. When there is a need for decoking, a portion of the stored utility fluid is conducted to reactor 110 under decoking conditions in order to lessen reactor pressure drop. Two reactors, first reactor 110A and second reactor 110B (not shown) can be operated in parallel, e.g., in "block mode", with valve means (not shown) utilized for directing (i) the tar-fluid mixture and (ii) treat gas to the first reactor and directing a decoking stream comprising at least a portion of the stored utility fluid for decoking the second reactor. After lessening the pressure drop of the second reactor, the valve means can be utilized for returning the second reactor to SCT hydroprocessing service, and, if desired, switching the decoking stream to the first reactor for lessening the first reactor's pressure drop. The invention is also compatible with decoking utilizing and oxidant, such as oxygen or air. Conventional oxidant decoking methods can be utilized, though the invention is not limited thereto. De-coking can also be accomplished, if desired, by removing process equipment and/or catalyst for renewal and/or regeneration, including removing deposits (including coke deposits) from process equipment by mechanical means.

All patents, test procedures, and other documents cited herein, including priority documents, are fully incorporated by reference to the extent such disclosure is not inconsistent and for all jurisdictions in which such incorporation is permitted. While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydrocarbon conversion process, comprising:

(a) providing a pyrolysis feedstock comprising ≥10.0 wt. % hydrocarbon based on the weight of the pyrolysis feedstock;

(b) pyrolysing the pyrolysis feedstock to produce a pyrolysis effluent comprising tar and ≥1.0 wt. % of $C_2$ unsaturates, based on the weight of the pyrolysis effluent;

(c) separating at least a portion of the tar from the pyrolysis effluent, wherein the separated tar contains ≥90 wt. % of the pyrolysis effluent's molecules having an atmospheric boiling point of ≥290° C.;

(d) providing a utility fluid, the utility fluid comprising 1-ring and/or 2-ring aromatics, in an amount ≥25.0 wt. % based on the weight of the utility fluid, the utility fluid having a final boiling point ≤430° C.;

(e) providing a treat gas comprising molecular hydrogen;

(f) hydroprocessing at least a portion of the separated tar in the presence of (i) the treat gas and (ii) the utility fluid under catalytic hydroprocessing conditions at a utility fluid:tar weight ratio in the range of 0.05 to 4.0, to produce a hydroprocessed product;

(g) separating a product overhead mixture and a product bottoms mixture from the hydroprocessed product, wherein (i) the product overhead mixture comprises at least a portion of any un-reacted treat gas and (ii) the product bottoms mixture comprising hydroprocessed tar;

(h) separating from the product bottoms mixture (i) a product vapor stream, (ii) a product liquid stream, and (iii) a side stream, the side stream having a final boiling point ≤430° C. and comprising 1-ring and/or 2-ring aromatics, in an amount ≥25.0 wt. % based on the weight of the side stream; and (i) conducting a portion of the side stream to step (d), wherein the utility fluid comprises ≥10.0 wt. % of the side stream, based on the weight of the utility fluid; and one or more of:

(j) heating the tar before step (f);

(k) conducting the hydroprocessed product through first channels of at least one treat gas heat exchanger and conducting at least a portion of the treat gas through second channels of the treat gas heat exchanger to transfer heat from the hydroprocessed product to the treat gas; and (l) conducting the tar-fluid mixture before step (f) through first channels of at least one tar-fluid mixture heat exchanger and conducting at least a portion of the hydroprocessed product through second channels of the tar-fluid-mixture heat exchanger to transfer heat from the hydroprocessed product to the tar-fluid mixture.

2. The process of claim 1, wherein (i) the hydroprocessing is conducted continuously in a hydroprocessing zone from a first time $t_1$ to a second time $t_2$, $t_2$ being $\geq(t_1+2.67\times10^6$ seconds) and (ii) hydroprocessing zone's pressure drop at the second time is less than 3.0 times the pressure drop at the first time.

3. The process of claim 2, wherein (i) $t_2$ is $\geq(t_1+3.2\times10^7$ seconds) and (ii) hydroprocessing zone's pressure drop at the second time is less than 2.0 times the pressure drop at the first time.

4. The process of claim 1, wherein the pyrolysis feedstock's hydrocarbon comprises one or more of naphtha, gas oil, vacuum gas oil, waxy residues, atmospheric residues, residue admixtures, or crude oil, the separated tar has an initial boiling point ≥200° C., the side stream has a final boiling point ≤400° C., and the utility fluid has a final boiling point ≤400° C.

5. The process of claim 1, wherein the pyrolysis effluent's tar comprises (i) ≥10.0 wt. % of molecules having an atmospheric boiling point ≥565° C. that are not asphaltenes, and (ii) $\leq 1.0\times10^3$ ppmw metals, the weight percents being based on the weight of the pyrolysis effluent's tar.

6. The process of claim 1, wherein the hydroprocessing is conducted at a temperature in the range of 200.0° C. to 450.0° C. in the presence of at least one hydroprocessing catalyst.

7. The process of claim 6, wherein the hydroprocessing is conducted at a pressure ≥500 psia (34 bar, absolute).

8. The process of claim 1, wherein the process further comprises (m) cooling the product overhead mixture;

(n) separating a fluid from the cooled product overhead mixture, the fluid having a final atmospheric boiling point ≤350° C. and comprising 1-ring and/or 2-ring aromatics in an amount ≥50.0 wt. %, based on the weight of the fluid; and (o) conducting at least a portion of the separated fluid to step (d), wherein the utility fluid further comprises ≥20.0 wt. % of the separated fluid, based on the weight of the utility fluid.

9. The process of claim 1, wherein the side stream has an 10% true boiling point ≥175.0° C. and a 90% true boiling point ≤400.0° C.

10. A steam cracked tar conversion process, comprising:

(a) providing a steam cracked tar;

(b) providing a utility fluid comprising a first utility fluid component, wherein the first utility-fluid component has a final boiling point ≤350° C. and comprises 1-ring and/or 2-ring aromatics in an amount ≥50.0 wt. %, based on the weight of the first utility-fluid component;

(c) providing a treat gas, the treat gas comprising ≥70.0 mole % of molecular hydrogen per mole of the treat gas;

(d) combining the steam cracked tar and the utility fluid to produce a tar-fluid mixture;

(e) exposing the tar-fluid mixture and treat gas under hydroprocessing conditions to a temperature in the range of from 300° C. to 500° C. to produce a hydroprocessed product, wherein the hydroprocessing consumes molecular hydrogen at a rate ≤267 standard $m^3$ of molecular hydrogen per $m^3$ of steam cracked tar;

(f) separating a product overhead mixture and a product bottoms mixture from the hydroprocessed product, wherein the product overhead mixture comprises aromatics, hydrogen sulfide and un-reacted treat gas; and the product bottoms mixture comprises hydroprocessed tar;

(g) separating from the product bottoms mixture (i) a product vapor stream, (ii) a product liquid stream, and (iii) a side stream, the side stream having a final boiling point ≤430° C. and comprising ≥25.0 wt. % of aromatics having one or two rings, based on the weight of the side stream;

(h) separating from the product overhead mixture (i) a spent treat gas mixture comprising molecular hydrogen and hydrogen sulfide and (ii) a fluid having an atmospheric final boiling point about ≤350° C. and comprising ≥50.0 wt. % of aromatics having one or two rings, based on the weight of the fluid; and (i) recycling at least a portion of the fluid separated in step (h) to step (b), wherein the first utility-fluid component comprises the recycled separated fluid.

11. The process of claim 10, wherein (A) the utility fluid further comprises a second utility fluid component, the second utility-fluid component having a final boiling point ≤430° C. and comprising 1-ring and/or 2-ring aromatics in an amount ≥25.0 wt. %, based on the weight of the second utility fluid component; and (B) the process further comprises recycling at least a portion of the side stream to step (b), wherein the second utility-fluid component comprises the recycled side stream.

12. The process of claim 11, wherein the second utility fluid has a true boiling point distribution having (i) an initial boiling point ≥300° F. (150° C.) and (ii) a final boiling point ≤800° F. (430° C.).

13. The process of claim 11, wherein the second utility fluid has a true boiling point distribution in the range of from 175° C. (350° F.) to about 400° C. (750° F.).

14. The process of claim 11, wherein (i) the utility fluid comprises ≥80 wt. % of the first and second utility-fluid components, based on the weight of the utility fluid.

15. The process of claim 11, wherein the utility fluid comprises ≥80 wt. % of the first utility-fluid component based on the weight of the utility fluid.

16. The process of claim 10, wherein (i) the hydroprocessing is catalytic hydroprocessing conducted in at least one hydroprocessing zone, the hydroprocessing zone comprising at least two catalyst beds, (ii) the total pressure in the hydroprocessing zone is in the range of 68 bar (absolute) to 135 bar (absolute), (iii) the second utility-fluid component and first-utility fluid components are combined at a (second utility-fluid component):(first utility-fluid component) weight ratio in the range of from 0.11 to 0.67, (iv) the first and second utility-fluid components are combined with the steam cracked tar at a [first utility-fluid component+second utility-fluid component]:steam cracked tar weight ratio in the range of from 0.05 to 4.00.

17. The process of claim 10, wherein (i) the hydroprocessing is conducted continuously in a hydroprocessing zone from a first time to a second time, the second time being ≥the first time plus $2.67\times10^6$ seconds, and (ii) hydroprocessing zone's pressure drop at the second time is less than 3.0 times the pressure drop at the first time.

18. The process of claim 17, wherein the hydroprocessing zone comprises at least one bed of high-activity hydrotreating catalyst.

19. The process of claim 10, wherein the hydroprocessing conditions includes a reactor pressure ≥68 bar absolute.

20. The process of claim 10, wherein the process further comprises one or more of:

(j) exposing the tar-fluid mixture to a temperature ≥300° C. before step (e) in at least one heater, wherein the tar-fluid mixture abstracts heat;

(k) conducting the tar-fluid mixture through first channels of at least one tar-fluid mixture heat exchanger before step (e); and further conducting at least a portion of the product overhead mixture through second channels of the tar-fluid mixture heat exchanger to transfer heat from the product overhead mixture to the tar-fluid mixture; and (l) conducting a portion of the product overhead mixture through first channels of at least one treat gas heat exchanger and conducting at least a portion of the treat gas through second channels of the treat gas heat exchanger to transfer heat from the treat gas to the product overhead mixture.

21. A steam cracked tar conversion process, comprising:

(a) providing a steam cracked tar;

(b) providing a utility fluid comprising first and second utility fluid components, wherein (i) the second utility-fluid component has a final boiling point ≤430° C. and comprises ≥25.0 wt. % of aromatics having one or two rings, based on the weight of the second utility-fluid component, and (ii) the first utility-fluid component has a final boiling point ≤350° C. and comprises a ≥50.0 wt. % of aromatics having one or two rings, based on the weight of the first utility-fluid component;

(c) providing a treat gas, the treat gas comprising molecular hydrogen;

(d) combining the steam cracked tar, the treat gas, and the utility fluid to produce a hydroprocessing feed mixture, and exposing the hydroprocessing feed under hydroprocessing conditions to a temperature in the range of from 300° C. to 500° C. to produce a hydroprocessed product, wherein (i) the utility fluid is combined with the steam cracked tar at a [utility fluid]:[steam cracked tar] weight ratio in the range of about 0.05 to 4.0;

(e) separating a product overhead mixture and a product bottoms mixture from the hydroprocessed product, wherein the product overhead mixture comprises aromatics, hydrogen sulfide and un-reacted treat gas; and the product bottoms mixture comprises hydroprocessed tar;

(f) separating from the product bottoms mixture (i) a product vapor stream, (ii) a product liquid stream, and (iii) a side stream, the side stream having a final boiling point ≤430° C. and comprising ≥25.0 wt. % of aromatics having one or two rings, based on the weight of the side stream;

(g) recycling at least a portion of the side stream to step (b) where the second utility-fluid component comprises the recycled side stream;

(h) separating from the product overhead mixture a spent treat gas mixture and a fluid, the fluid having a final boiling point ≤350° C. and comprising ≥50.0 wt. % of aromatics having one or two rings, based on the weight of the fluid; and (i) recycling at least a portion of the fluid separated in step (h) to step (b), wherein the first utility-fluid component comprises the recycled separated fluid.

22. The process of claim 21, wherein (A) the utility fluid is a combined utility fluid, the combined utility fluid consisting essentially of the first and second utility fluid components, (B) the mass ratio of [1-ring aromatics+2-ring aromatics]: saturated hydrocarbon molecules in the combined utility fluid is increased over that of the second utility-fluid component by a factor ≥1.5, and (C) the second utility-fluid component has a final boiling point ≤400° C.

23. The process of claim 21, wherein the process further comprises the steps of:

(j) exposing the hydroprocessing feed mixture to a temperature ≥300° C. before step (e) in at least one heater to heat the hydroprocessing feed mixture;

(k) conducting the product overhead mixture through first channels of at least one treat gas heat exchanger and conducting at least a portion of the treat gas through second channels of the treat gas heat exchanger to transfer heat to the treat gas from the product overhead mixture; and (l) conducting the steam cracked tar and/or the utility fluid through first channels of at least one tar-fluid heat exchanger before step (e) and conducting the portion of product overhead mixture passing through the treat gas heat exchanger through second channels of the tar-fluid heat exchanger to transfer heat from the product overhead mixture to the steam cracked tar and/or the utility fluid.

24. The process of claim 21, further comprising cooling the spent treat gas mixture and separating from the cooled spent treat gas mixture a second fluid comprising hydrocarbon.

25. The process of claim 24, further comprising the steps of combining the second fluid with the product bottoms mixture and wherein at least a portion of the treat gas's molecular hydrogen is obtained from the spent treat gas.

26. A hydrocarbon conversion process, comprising:

(a) providing a pyrolysis feedstock comprising ≥10.0 wt. % hydrocarbon based on the weight of the pyrolysis feedstock;

(b) pyrolysing the pyrolysis feedstock to produce a pyrolysis effluent comprising ≥0.1 wt. % of $C_2$ unsaturates, based on the weight of the pyrolysis effluent;

(c) separating tar from the pyrolysis effluent, wherein the separated tar contains ≥90 wt. % of the pyrolysis effluent's molecules having an atmospheric boiling point of ≥290° C.;

(d) providing a utility fluid, the utility fluid comprising 1-ring and/or 2-ring aromatics, in an amount ≥25.0 wt. % based on the weight of the utility fluid, the utility fluid having a final boiling point ≤400° C.;

(e) providing a treat gas comprising molecular hydrogen;

(f) hydroprocessing at least a portion of the separated tar in the presence of (i) the treat gas and (ii) the utility fluid under catalytic hydroprocessing conditions at a utility fluid:tar weight ratio in the range of 0.05 to 4.0, to produce a hydroprocessed product;

(g) separating a product overhead mixture and a product bottoms mixture from the hydroprocessed product, wherein (i) the product overhead mixture comprises a portion of the un-reacted treat gas and optionally hydrogen sulfide, and (ii) the product bottoms mixture comprises hydroprocessed tar;

(h) separating from the product overhead mixture at least (i) a product vapor stream, (ii) a product liquid stream;

(i) separating from the product liquid stream at least a spent treat gas mixture and a fluid stream, the fluid stream having final boiling point ≤400° C. and comprising 1-ring and/or 2-ring aromatics, in an amount ≥25.0 wt. % based on the weight of the fluid stream; and (j) recycling at least a portion of the fluid stream to step (d), wherein the utility fluid comprises ≥10.0 wt. % of the recycled fluid stream, based on the weight of the utility fluid.

* * * * *